US007208877B2

(12) United States Patent
Shinoda et al.

(10) Patent No.: US 7,208,877 B2
(45) **Date of Patent: *Apr. 24, 2007**

(54) FULL COLOR SURFACE DISCHARGE TYPE PLASMA DISPLAY DEVICE

(75) Inventors: Tsutae Shinoda, Kawasaki (JP); Noriyuki Awaji, Kawasaki (JP); Shinji Kanagu, Kawasaki (JP); Tatsutoshi Kanae, Kawasaki (JP); Masayuki Wakitani, Kawasaki (JP); Toshiyuki Nanto, Kawasaki (JP); Mamaru Miyahara, deceased, late of Kawasaki (JP); by Takeo Miyahara, legal representative, Kobe (JP); by Shizuko Miyahara, legal representative, Kobe (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/902,813

(22) Filed: Aug. 2, 2004

(65) Prior Publication Data

US 2005/0001550 A1 Jan. 6, 2005

Related U.S. Application Data

(63) Continuation of application No. 09/993,650, filed on Nov. 27, 2001, now Pat. No. 6,838,824, which is a continuation of application No. 09/654,893, filed on Sep. 5, 2000, now Pat. No. 6,787,995, which is a continuation of application No. 09/654,894, filed on Sep. 5, 2000, now Pat. No. 6,861,803, which is a continuation of application No. 08/800,759, filed on Feb. 13, 1997, now Pat. No. 6,195,070, which is a continuation of application No. 08/469,815, filed on Jun. 6, 1995, now Pat. No. 5,661,500, which is a continuation of application No. 08/010,169, filed on Jan. 28, 1993, now abandoned.

(30) Foreign Application Priority Data

| | | |
|---|---|---|
| Jan. 28, 1992 | (JP) | 4-012976 |
| Apr. 16, 1992 | (JP) | 4-96203 |
| Apr. 24, 1992 | (JP) | 4-106953 |
| Apr. 24, 1992 | (JP) | 4-106955 |
| Apr. 30, 1992 | (JP) | 4-110921 |

(51) Int. Cl.
*H01J 17/49* (2006.01)

(52) U.S. Cl. ..... 313/582; 313/586; 313/587; 313/584

(58) Field of Classification Search ..... 313/582–587
See application file for complete search history.

(56) References Cited

U.S. PATENT DOCUMENTS

| | | | | |
|---|---|---|---|---|
| 3,885,195 | A * | 5/1975 | Amano | 313/584 |
| 3,886,403 | A | 5/1975 | Owaki et al. | 315/169 R |
| 3,906,290 | A | 9/1975 | Kurahashi et al. | 315/169 R |
| 3,972,040 | A | 7/1976 | Hilsum et al. | 340/324 M |
| 4,005,402 | A | 1/1977 | Amano | 340/324 M |
| 4,162,427 | A | 7/1979 | Kamegaya et al. | |
| 4,170,772 | A | 10/1979 | Bly | |
| 4,249,105 | A | 2/1981 | Kamagaya et al. | 313/484 |
| 4,368,465 | A | 1/1983 | Hirakawa et al. | 340/771 |
| 4,499,460 | A | 2/1985 | Pearson et al. | 340/771 |
| 4,516,053 | A | 5/1985 | Amano | 313/584 |
| 4,575,716 | A | 3/1986 | Holz et al. | 340/714 |
| 4,622,549 | A | 11/1986 | Criscimagna et al. | 340/805 |
| 4,638,218 | A | 1/1987 | Shinoda et al. | 315/169.4 |
| 4,692,662 | A | 9/1987 | Wada et al. | |
| 4,716,341 | A | 12/1987 | Oida et al. | 315/169.4 |
| 4,725,255 | A | 2/1988 | Shinada et al. | |
| 4,737,687 | A | 4/1988 | Shinoda et al. | 315/169.4 |
| 4,814,758 | A | 3/1989 | Park | 340/771 |
| 4,833,463 | A | 5/1989 | Dick et al. | |
| 5,030,888 | A | 7/1991 | Salavin et al. | 315/169.4 |
| 5,086,297 | A | 2/1992 | Miyake et al. | 340/759 |
| 5,138,225 | A * | 8/1992 | Kim | 313/584 |
| 5,144,200 | A * | 9/1992 | Kim | 313/584 |
| 5,182,489 | A | 1/1993 | Sano | 313/485 |
| 5,212,472 | A | 5/1993 | Takashi et al. | |
| 5,272,472 | A | 12/1993 | Buzak | |
| 5,396,149 | A | 3/1995 | Kwon | |
| 5,541,618 | A | 7/1996 | Shinoda | |

| | | | |
|---|---|---|---|
| 5,661,500 | A | 8/1997 | Shinoda et al. |
| 5,674,553 | A | 10/1997 | Shinoda et al. |
| 5,724,054 | A | 3/1998 | Shinoda |
| 5,828,356 | A | 10/1998 | Stoller |
| 6,097,357 | A | 8/2000 | Shinoda et al. |

FOREIGN PATENT DOCUMENTS

| | | | |
|---|---|---|---|
| EP | 0 157 248 | | 10/1985 |
| EP | 0 366 117 | | 5/1990 |
| EP | 0 436 416 | | 7/1991 |
| FR | 2 662 534 | | 11/1991 |
| JP | 49-115242 | | 11/1974 |
| JP | 50-135979 | | 10/1975 |
| JP | 51-032051 | | 9/1976 |
| JP | 55-5663 | | 2/1980 |
| JP | 56-094395 | | 7/1981 |
| JP | 57-078751 | | 5/1982 |
| JP | 59108240 | A | 6/1984 |
| JP | 61-039341 | | 2/1986 |
| JP | 62-51133 | | 3/1987 |
| JP | 62-180932 | | 8/1987 |
| JP | 62195829 | A | 8/1987 |
| JP | 63-151997 | | 6/1988 |
| JP | 63-060495 | | 11/1988 |
| JP | 1-304638 | | 12/1989 |
| JP | 01-304638 | | 12/1989 |
| JP | 1-311540 | | 12/1989 |
| JP | 01-313837 | | 12/1989 |
| JP | 2-148645 | | 6/1990 |
| JP | 02-219092 | | 8/1990 |
| JP | 2-226699 | | 9/1990 |
| JP | 02288047 | A | 11/1990 |
| JP | 02-291597 | | 12/1990 |
| JP | 02297837 | A | 12/1990 |
| JP | 3-77238 | | 4/1991 |
| JP | 03-078937 | | 4/1991 |
| JP | 3-101031 | | 4/1991 |
| JP | 3-269933 | | 12/1991 |
| JP | 05109363 | A | 4/1993 |

OTHER PUBLICATIONS

Shinoda et al., "Low-Voltage Operated AC Plasma-Display Panels," *IEEE Transactions on Electron Devices,* vol. ED-26, No. 8, Aug. 1979, pp. 1163-1167.

Gay et al., "Color Plasma Display Panels with Simplified Structure and Drive," *SID 88 DIGEST,* SID International Symposium—Digest of Technical Papers, May 24-26, 1988, Anaheim, CA, pp. 157-159.

Ruckmongathan, T.N., "A Generalized Addressing Technique for RMS Responding Matrix LCDS," *1988 International Display Research Conference,* pp. 80-85.

Uchiike et al., "An 86-lpi High-Resolution Full-Color Surface-Discharge ac Plasma Display Panels," *Proceedings of the SID,* vol. 31, No. 4, 1990, New York, NY, pp. 361-365.

Yoshikawa et al., "A Full Color AC Plasma Display with 256 Gray Scale," *Japan Display '92,* Article S16-2, pp. 605-608.

Holz, G.E., "Pulsed Gas Discharge Display with Memory," Burroughs Corporation, ECD, Plainfield, N.J. (2 pages).

Makino et al., "Improvement of Video Image Quality in AC-Plasma Display Panels by Suppressing the Unfavorable Coloration Effect with Sufficient Gray Shades Capability," *Asia Display '95,* Proceedings of the Fifteenth International Display Research Conference, Oct. 16-18, 1995, Hamamatsu, Japan, Article S19-3, pp. 381-384.

Osamu, T., "Innovation and Commercial Viability of Large Area Plasma Display through Fujitsu's Continued R&D Activities," *IDW '96,* Proceedings of the Third International Display Workshops, vol. 2, Nov. 27-29, 1996, Kobe, Japan, pp. 7-10.

Kubo, Akira, et al., "Full Color Surface-Discharge ac Plasma Display Panels", ITEJ, Technical Report, vol. 12, No. 49, pp. 49-54, EP '88-579, 10 '88-93 (Nov. 1988).

* cited by examiner

*Primary Examiner*—Mariceli Santiago
(74) *Attorney, Agent, or Firm*—Staas & Halsey LLP

(57) ABSTRACT

A full color three electrode surface discharge type plasma display device that has fine image elements and is large and has a bright display. The three primary color luminescent areas are arranged in the extending direction of the display electrode pairs in a successive manner and an image element is composed by the three unit luminescent areas defined by these three luminescent areas and address electrodes intersecting these three luminescent areas. Further, phosphors are coated not only on a substrate but also on the side walls of the barriers and on address electrodes. The manufacturing processes and operation methods of the above constructions are also disclosed.

4 Claims, 19 Drawing Sheets

FULL COLOR SURFACE DISCHARGE TYPE PLASMA DISPLAY DEVICE

The subject application is a continuation of U.S. Ser. No. 09/993,650, filed Nov. 27, 2001, now U.S. Pat. No. 6,838,824, which is a continuation of U.S. Ser. No. 09/654,893 now U.S. Pat. No. 6,787,995 and U.S. Ser. No. 09/654,894, and now U.S. Pat. No. 6,861,803, both of which were filed Sep. 5, 2000, which are continuations of U.S. Ser. No. 08/800,759 filed Feb. 13, 1997, now U.S. Pat. No. 6,195,070, which is a continuation of U.S. Ser. No. 08/469,815 filed Jun. 6, 1995, now U.S. Pat. No. 5,661,500, which is a continuation of U.S. Ser. No. 08/010,169, filed Jan. 28, 1993, now abandoned.

BACKGROUND OF THE INVENTION

1. Field of the Invention

The present invention relates to a surface discharge type full color surface discharge type plasma display panel and a process for manufacturing the same. More specifically, the present invention relates to a full color ac plasma display device high in resolution and brightness of display such that it is adaptable to a high quality display, such as a high definition TV, and can be used in daylight.

2. Description of the Related Art

A plasma display panel (PDP) has been considered the most suitable flat display device for a large size, exceeding over 20 inches, because a high speed display is possible and a large size panel can easily be made. It is also considered to be adaptable to a high definition TV. Accordingly, an improvement in full color display capability in plasma display panels is desired.

In the past, two electrode type dc and ac plasma display panels have been proposed and developed. Also, a surface discharge type ac plasma display panel, among other plasma display panels, has been known to be suitable for a full color display.

For example, a surface discharge type ac plasma-display panel having a three electrode structure comprises a plurality of parallel display electrode pairs formed on a substrate and a plurality of address electrodes perpendicular to the display electrode pairs for selectively illuminating unit luminescent areas. Phosphors are arranged; in order to avoid damage by ion bombardment, on the other substrate facing the display electrode pairs with a discharge space between the phosphor and the display electrode pairs and are excited by ultra-violet rays generated from a surface discharge between the display electrodes, thereby causing luminescence. See for example, U.S. Pat. No. 4,638,218 issued on Jan. 20, 1987 and U.S. Pat. No. 4,737,687 issued on Apr. 12, 1988.

The full color display is obtained using an adequate combination of three different colors, such as red (R), green (G) and blue (B), and an image element is defined by at least three luminescent areas corresponding to the above three colors.

Conventionally, an image element is composed of four subpixels arranged in two rows and two columns, including a first color luminescent area, for example, R, a second color luminescent area, for example, G, a third color luminescent area, for example, G, and a fourth color luminescent area, for example, B. Namely, this image element comprises four luminescent areas of a combination of three primary colors for additive mixture of colors and an additional green having a high relative luminous factor. By controlling the additional green area independent from the other three luminescent areas, an apparent image element number can be increased and thus an apparent higher resolution or finer image can be obtained.

In this arrangement of four subpixels, two pairs of display electrodes cross an image element, i.e., each pair of display electrodes crosses each row or column of subpixels, which is apparently disadvantageous in making image elements finer.

If the image elements are to be finer, formation of finer display electrodes becomes difficult and the drive voltage margin for avoiding interference of discharge between different electrode lines becomes narrow. Moreover, the display electrodes become narrower, which may cause damage to the electrodes. Further, a display of one image element requires time for scanning two lines, which may make a high speed display operation difficult because of the frequency limitation of a drive circuit.

The present invention is directed to solve the above problem and provide a flat panel full color surface discharge-type plasma display device having fine image elements.

JP-A-01-304638, published on Dec. 8, 1989, discloses a plasma display panel in which a plurality of parallel barriers are arranged on a substrate and luminescent areas, in the form of strips defined by the parallel barriers, are formed. This disclosure is, however, directed only to two electrode type plasma display panels, not to a three electrode type plasma display panel in which parallel display electrode pairs and address electrodes intersecting the display electrode pairs are arranged and three luminescent areas are arranged in the direction of the extending lines of the display electrode pairs as in the present invention.

The present invention is also directed to a plasma display panel exhibiting a high image brightness at a wide view angle range. In this connection, U.S. Pat. No. 5,086,297 issued on Feb. 4, 1992, corresponding to JP-A-01-313837 published on Dec. 19, 1989, discloses a plasma display panel in which phosphors are coated on side walls of barriers. Nevertheless, in this plasma display panel, the phosphors are coated selectively on the side walls of barriers and do not cover the flat surface of the substrate on which electrodes are disposed.

SUMMARY OF THE INVENTION

To attain the above and other objects of the present invention, there is provided a full color surface discharge type plasma display device comprising pairs of lines of display electrodes (X and Y), each pair of lines of display electrodes being parallel to each other and constituting an electrode pair for surface discharge; lines of address electrodes (22 or A) insulated from the display electrodes and running in a direction intersecting the lines of display electrodes; three phosphor layers (28R, 28G and 28B), different from each other in respective luminescent colors, facing the display electrodes and arranged in a successive order of the three phosphor layers along the extending lines of the display electrodes, and a discharge gas in a space (30) between said display electrodes and said phosphor layers, wherein the adjacent three phosphor layers (28R, 28G and 28B) (EU) of said three different luminescent colors and a pair of lines of display electrodes define one image element (EG) of a full color display.

In accordance with the present invention, there is also provided a full color surface discharge plasma display device comprising first and second substrates facing and parallel to each other for defining a space in which a discharge gas is filled; pairs of lines of display electrodes formed on the first substrate facing the second substrate, each pair of lines of display electrodes being parallel to each other and constituting an electrode pair for surface discharge; a dielectric layer over the display electrodes and the first substrate; lines of address electrodes formed on the second substrate facing the first substrate and running in a direction intersecting the lines of display electrodes; three phosphor layers, different from each other in respective luminescent colors, formed on the second substrate in a successive order of said three luminescent colors along the extending lines of the display electrodes, the phosphor layers entirely covering the address electrodes; and barriers standing on the second substrate to divide and separate said discharge space into cells corresponding to respective phosphor layers, the barriers having side walls; wherein the adjacent three phosphor layers of said three different luminescent colors and a pair of lines of display electrodes define one image element of a full color display and said phosphor layers extend to the side walls of said barriers to cover almost the entire surfaces of the side walls of said barriers.

In accordance with a preferred embodiment of the present invention, there is provided a full color surface discharge plasma display device comprising first and second substrates facing and parallel to each other for defining a space in which a discharge gas is filled, the first substrate being disposed on a side of a viewer; pairs of lines of display electrodes formed on the first substrate facing the second substrate, each pair of lines of display electrodes being parallel to each other and constituting an electrode pair for surface discharge, each of the display electrodes comprising a combination of a transparent conductor line and a metal line in contact with said transparent conductor line and having a width narrower than that of the transparent conductor line; a dielectric layer over the display electrodes and the first substrate; lines of address electrodes formed on the second substrate facing the first substrate and running in a direction intersecting the lines of display electrodes; barriers standing on the second substrate, in parallel to said address electrodes, for dividing said discharge gas space into cells, the barriers having side walls; and three phosphor layers, different from each other in respective luminescent colors formed on the second substrate in a successive order of said three luminescent colors along the extending lines of the display electrodes, the phosphor layers entirely covering the address electrodes and extending to the side walls of said barriers to cover almost the entire surfaces of the side walls of said barriers; wherein the adjacent three phosphor layers of said three different luminescent colors and a pair of lines of display electrodes define one image element of a full color display.

To protect the phosphor provided over the address electrode from ion bombardment, the following drive can be adopted. First, an erase address type drive control system in which once all image elements corresponding the pair of to the display electrodes are written, an erase pulse is applied to one of the pair of the display electrodes and simultaneously an electric field control pulse for neutralizing or canceling the applied erase pulse is selectively applied to the address electrodes.

Second, a write address type drive control system is provided in which in displaying a line corresponding to a pair of the display electrodes, a discharge display pulse is applied to one of the pair of the display electrodes and simultaneously an electric field control pulse for writing is selectively applied to the address electrodes. This write address type drive control system is preferably constituted such that in displaying a line corresponding to a pair of the display electrodes, once all image elements corresponding to the display electrodes are subject to writing and erasing discharges, to store positive electric charges above said phosphor layers and negative electric charges above said insulating layer, an electric discharge display pulse is applied to one of the pair of the display electrodes to make said one of the pair of the display electrodes negative in electric potential to the other of the pair of the display electrodes, and an electric discharge pulse is selectively applied to the address electrodes to make the address electrodes positive in electric potential relatively to said one of the pair of the display electrodes.

It is preferred in the above full colorsurface discharge plasma display device that the image element has an almost square area and each of the three phosphor layers has a rectangular shape that is obtained by dividing the square of the image element and is long in a direction perpendicular to the lines of display electrodes. Additionally, it is preferred that each of the lines of the display electrodes comprises a combination of a transparent conductor line and a metal line in contact with the transparent conductor line and having a width narrower than that of the transparent conductor line and is disposed on the side of a viewer compared with the phosphor layers; the transparent conductor lines have partial cutouts in such a shape that the surface discharge is localized to a portion between the display electrodes without the cutout in each unit luminescent area; the total width of a pair of the display electrodes and a gap for discharge formed between the pair of the display electrodes is less than 70% of a pitch of the pairs of display electrodes; the device further comprises barriers standing on a substrate and dividing and separating the space between the display electrodes and the phosphor layers into cells corresponding to respective phosphor layers; the barriers have side walls and the phosphor layers extend to and almost entirely cover the side walls of the barriers; the address electrodes exist on a side of the substrate opposite to the display electrodes and the address electrodes are entirely covered with the phosphor layers; the device further comprises a substrate and a underlying layer of a low melting point glass containing a light color colorant formed on the substrate and the address electrodes are formed on the underlying layer; at least part of the barriers comprises a low melting point glass containing a light color colorant; and the barriers comprise a low melting point glass containing a dark color colorant in a top portion thereof and a low melting point glass admixed with a light color colorant in the other portion.

In accordance with the present invention, there is also provided a process for manufacturing a full color surface discharge plasma display device as above, in which the address electrodes and the barriers are parallel to each other and the address electrodes comprise a main portion for display parallel to the barriers and a portion at an end of said main portion for connecting to outer leads, the process comprising the steps of printing a material for forming the main portions of the address electrodes using a printing mask, printing a material for forming the outer lead-connecting portions, and printing a material for forming the barriers using the printing mask used for printing the material for forming the main portions of the address electrodes.

Further, there is also provided a process for manufacturing a full color surface discharge type plasma display device as above. This process comprises the steps of forming the barriers on the second substrate, almost filling gaps between the barriers above the second substrate with a phosphor paste, firing the phosphor paste to reduce the volume of the phosphor paste and form recesses between the barriers and to form a phosphor layer covering almost the entire surfaces of side walls of the barriers and covering surfaces of the second substrate between the barriers.

It is preferred that the phosphor paste comprise 10 to 50% by weight of a phosphor and the filling of the phosphor paste be performed by screen printing the phosphor paste into the spaces with a square squeezer at a set angle of 70 to 85 degrees.

DESCRIPTION OF THE PREFERRED EMBODIMENTS

Before describing the present invention in more detail, the prior art is described with reference to drawings so as to understand the present invention more clearly.

Figure 3A:
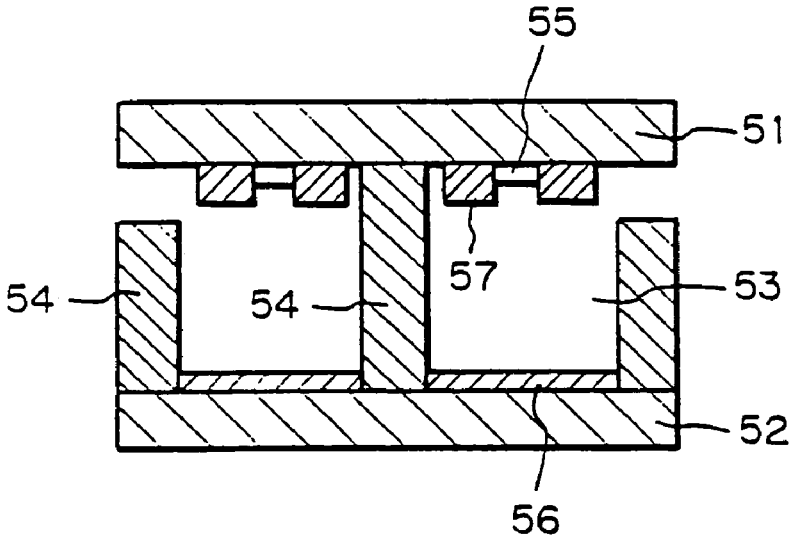
Fig. 3A PRIOR ART
FIG. 3A shows a first structure of plasma display devices of the prior art.
Figure 3B:
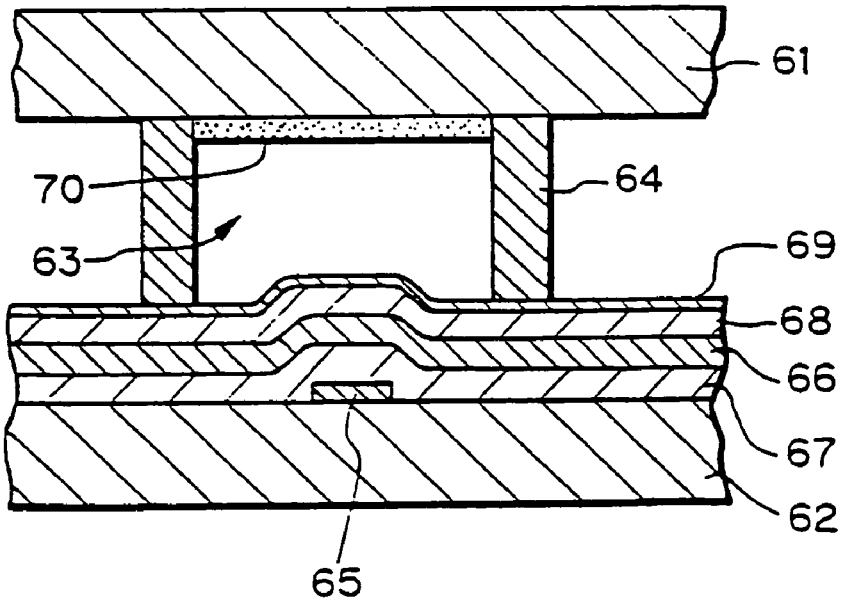
Fig. 3B PRIOR ART
FIG. 3B shows a second structure of plasma display devices of the prior art.

FIGS. 3A and 3B show the basic respective constructions of dc and ac two electrode plasma display panels. These constructions of two electrode plasma display panels appear in FIGS. 5 and 6 of JP-A-01-304638. In FIG. 3A of the present application, i.e., an opposite discharge type dc plasma display panel, two substrates 51 and 52 are faced parallel to each other. Gas discharge cells 53 are defined by straight cell barriers 54 and the two substrates 51 and 52. A discharge gas exists in the discharge cells 53. An anode 55 is formed on a substrate 51 on the side of the viewer. A cathode 56 is formed on the other substrate 52. A phosphor layer 57, in the form of strip, is formed on the substrate 51, such that the anode 55 and the phosphor layer 57 do not overlap each other. When a dc voltage is applied between the anode 55 and the cathode 56, an electric discharge emitting ultra-violet rays occurs in the discharge cell 53, which illuminates the phosphor layer 57. Separating the phosphor layer 57 from the anode 55 is to prevent damages of the phosphor layer by ion bombardment due to the discharge, since if the phosphor layer overlaps the anode 55, ion bombardment of the anode damages the phosphor layer on the anode 55.

This conventional panel is an opposite discharge type and different from the surface discharge type of the present invention. Although the phosphors and barriers are straight or in the form of strips, the opposite electrodes are arranged to intersect with each other and the phosphors extend in the direction of one of the extending lines of the opposite electrodes. In the opposite discharge type plasma display panel, ions generated during the discharge bombard and deteriorate the phosphors, thereby shortening the life of the panel. In contrast, in a three electrode surface discharge type panel, discharge occurs between the parallel display electrode pairs formed on one substrate, which prevents deterioration of the phosphor disposed on the other side substrate.

FIG. 3B, i.e., a surface discharge type ac plasma display device, two substrates 61 and 62 are faced parallel to each other. Gas discharge cells 63 are defined by straight cell barriers 64 and the two substrates 61 and 62. A discharge gas exists in the discharge cells 63. Two electrodes 65 and 66, arranged normal to each other in plane view, are formed on the substrate 62 with a dielectric layer 67 therebetween. A second dielectric layer 68 and a protecting layer 69 are stacked on the dielectric layer 67. A phosphor layer 70 is formed as a strip on the substrate 61. When an electric field is applied between the two electrodes 65 and 66, a discharge generating ultraviolet rays occurs, which illuminates the phosphor layer 70.

In this conventional surface discharge type panel, the straight barriers and the strip phosphors are parallel to each other, but the pair of display electrodes are arranged to intersect with each other and the phosphors extend in the direction of one of the display electrode pair. In contrast, the three different luminescent color phosphors are arranged in the extending direction of the parallel display electrode pairs.

This conventional surface discharge type panel has several disadvantages. Selection of the materials of the X and Y display electrodes is difficult since the two electrode layers X and Y are stacked upon each other (as a dielectric layer disposed between the two display electrodes is made of a low melting point glass, failure of the upper electrode on the low melting point glass or a short circuit may occur when the low melting point glass is fired). Additionally, a protecting layer at the cross section (i.e., intersection) of the X and Y display electrodes is damaged by discharge due to the electric field concentration there, which causes variation of the discharge voltage. Further, a large capacitance caused by the stack of the two electrodes on one substrate results in disadvantageous drive. As a result of these disadvantages, this type of panel has never been put into practical use.

Figure 4:
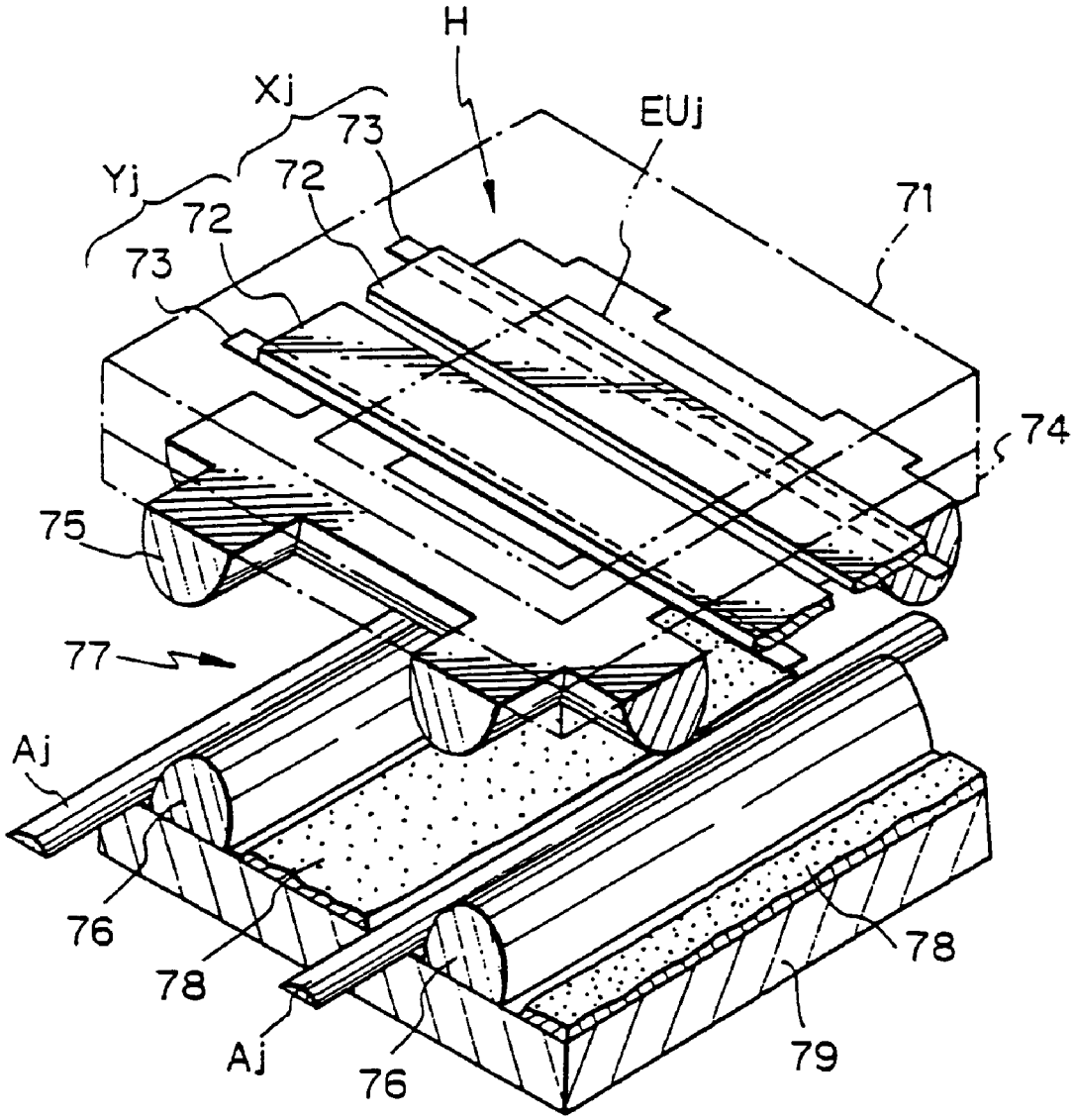
Fig. 4 PRIOR ART
FIG. 4 shows a third structure of plasma display devices of the prior art.

Also known is a three electrode type surface gas discharge ac plasma display panel as shown in FIG. 4. A display electrode pair Xj and Yj, each comprising a transparent conductor strip 72 and a metal layer 73, are formed on a glass substrate 71 on the display surface side H. A dielectric layer 74 for an ac drive is formed on the substrate 71 to cover the display electrodes Xj and Yj. A first barrier 75 in the form of a cross lattice, defining a unit luminescent area EUj, is formed on the glass substrate 71. Parallel second barriers 76, corresponding to the vertical lines of the barrier 75, are formed on a glass substrate 79 so that discharge cells 77 are defined between the substrates 71 and 79 by the first and second barriers 75 and 76. An address electrode Aj and a phosphor layer 78 are formed on the substrate 79. The address electrode Aj, which selectively illuminates the unit luminescent area EU, and the phosphor layer 78 intersects the display electrode pair Xj and Yj. The address electrode Aj is formed adjacent to the one side barrier 76 and the phosphor layer 78 is adjacent to the other side barrier 76. The address electrode Aj may be formed on the side of the substrate 71, for example, below the display electrode pairs Xj and Yj with a dielectric layer therebetween.

In this ac plasma discharge panel, erase addressing, in which writing (formation of a stack of wall charges) of a line L is followed by selective erasing, and a self-erase discharge is utilized for selective erasing, is typically used.

Figure 5:
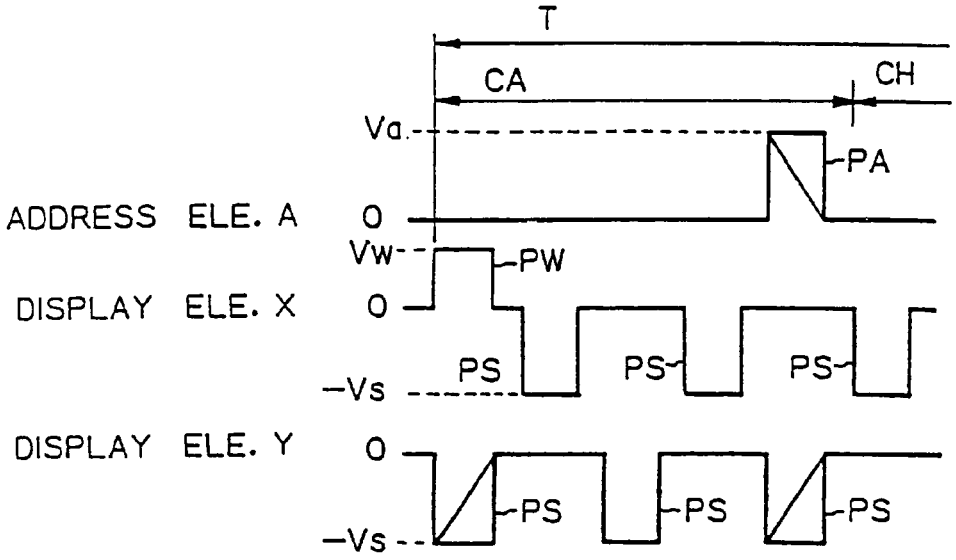
Fig. 5 PRIOR ART
FIG. 5 shows a first operation of plasma display devices of the prior art.

More specifically, referring to FIGS. 4 and 5, in an initial address cycle CA of a line display period T corresponding to one line display, a positive writing pulse PW having a wave height Vw is applied to display electrodes Xj, which corresponds to a line to be displayed. Simultaneously, a negative discharge sustain pulse having a wave height Vs is simultaneously applied to a display electrode Y corresponding to the-line to be displayed. In FIG. 5, the inclined line added to the discharge sustain voltage PS indicates that it is selectively applied to respective lines.

At this time, a relative electrical potential between the display electrodes Xj and Yj, i.e., a cell voltage applied to the surface discharge cell, is above the firing voltage; therefore, surface discharge occurs in all surface discharge cells C corresponding to one line. By the surface discharge, wall charges, having polarities opposite to those of the applied voltage, are stacked on the protecting layer 18 and, accordingly, the cell voltage is lowered to a predetermined voltage at which the surface discharge stops. The surface discharge cells are then in the written state.

Next, a discharge sustain pulse PS is alternately applied to the display electrodes Xj and Yj, and by superimposing the voltage Vs of the discharge sustain pulse PS onto the wall charges, the cell voltages then become the above firing voltage and surface discharge occurs every time one of the discharge sustain pulses PS is applied.

After the written state is made stable by a plurality of surface discharges, at an end stage of the address cycle CA, a positive selective discharge pulse PA having a wave height Va is applied to address electrodes corresponding to unit luminescent areas EU to be made into a non-display state in one line. Simultaneously, the discharge sustain pulse PS is applied to the display electrode Yj, to erase the wall charges unnecessary for display (selective erase). In FIG. 5, the inclined line added to the selective discharge pulse PA indicates that it is selectively applied to each of the unit luminescent areas EU in one line.

At a rising edge of the selective discharge pulse PA, an opposite discharge occurs at an intersection between the address electrode Aj and the display electrode Yj in the direction of the gap of the discharge space 30 between the substrates 11 and 21. By this discharge, excess wall charges are stacked in surface discharge cells and when the selective discharge pulse PA is lowered and the discharge sustain pulse PS is raised, a discharge due to the wall charges only occurs (self-erase discharge). The self-erase discharge has a short discharge sustain time since no discharge current is supplied from the electrodes. Accordingly, the wall charges disappear in the form of neutralization.

In the following display cycle CH, the discharge sustain voltage PS is alternately applied to the display electrodes Xj and Yj. At every rising edge of the discharge sustain voltage PS, only the surface discharge cells C in which the wall charges are not lost are subject to discharge, by which ultra-violet rays are irradiated to excite and illuminate the phosphor layers 28. In the display cycle CH, the period of the discharge sustain voltage PS is selected so as to control the display brightness.

The above operation is repeated for every line display period T and the display is performed for respective lines.

It is noted that it is possible for the writing to be performed simultaneously for all lines followed by line-by-line selective erasing of wall discharges, so that the writing time in an image display period (field) is shortened and the operation of display is sped up.

In this three electrode type ac plasma discharge panel, the selection of the discharge cell for electric discharge is memorized and the power consumption for display or sustainment of discharge can be lowered. Second, the electric discharge occurs near the surface of the protecting layer on the display electrode pair Xj and Yj so that damage of the phosphor layer by ion bombardment can be prevented, particularly when the phosphor layer and the address electrode are separated.

Figure 6:
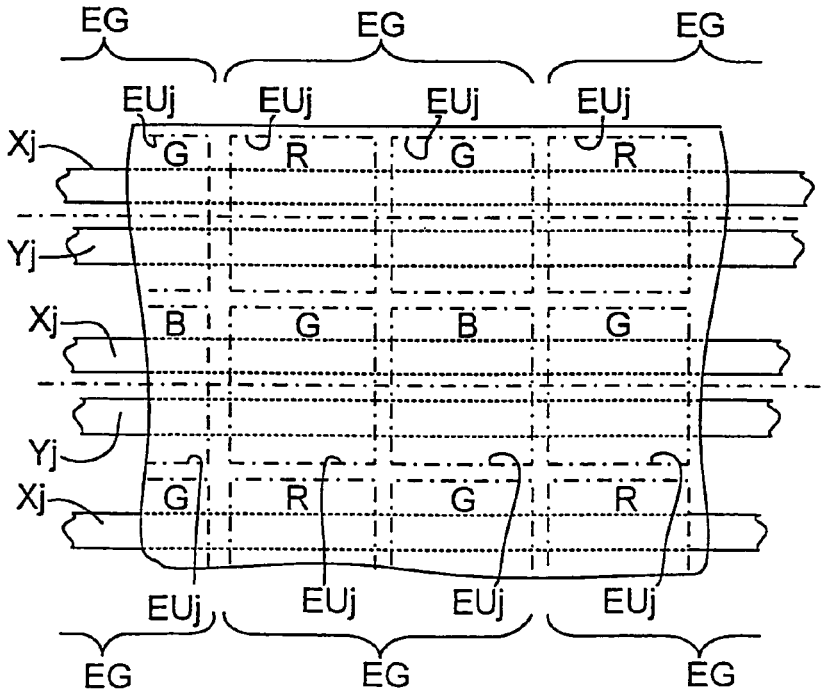
Fig. 6 PRIOR ART
FIG. 6 shows a fourth structure of plasma display devices of the prior art.

FIG. 6 shows a typical arrangement of three different color phosphor layers for a full color display in a three electrode type ac plasma discharge panel. In FIG. 6, EG denotes an image element, EUj denotes a unit luminescent area, R denotes a unit luminescent area of red, G denotes a unit luminescent area of green, B denotes a unit luminescent area of blue, and Xj and Yj denote a pair of display electrodes, respectively.

As seen in FIG. 6, one display line L is defined by the pair of display electrodes Xj and Yj, and each image element EG is composed of four unit luminescent areas EUj of two rows and two columns, to which two lines L, i.e., four display electrodes Xj and Yj correspond. In an image element EG, the left upper unit luminescent area EUj is a first color, e.g. R, the right upper and left lower unit luminescent areas EUj are a second color, e.g. G, and the right lower unit luminescent area EUj is a third color, e.g. B. More specifically, the image element EG includes a combination of unit luminescent areas EUj of the three primary colors for mixture of additive colors. EG also includes an additional unit luminescent area EUj of green having a high relative luminous factor. The additional unit luminescent area EUj of green permits an increase in the apparent number of image elements by independent control thereof from the other three unit luminescent areas EUj.

In this arrangement of the unit luminescent areas EUj, as described before, the four display electrodes required in an image element are disadvantageous in making the image elements finer. First, the formation of a fine electrode pattern has a size limitation. Second, if the gap between the display lines L is too narrow, a margin for preventing an interference between discharges on the display lines becomes too small. Third, if the width of the display electrodes is too narrow, the display electrodes tend to be broken or cut. Fourth, a display of an image element requires time for scanning two lines L, which may make a high speed display operation difficult, particularly when a panel size or image element number is increased.

Figure 1:
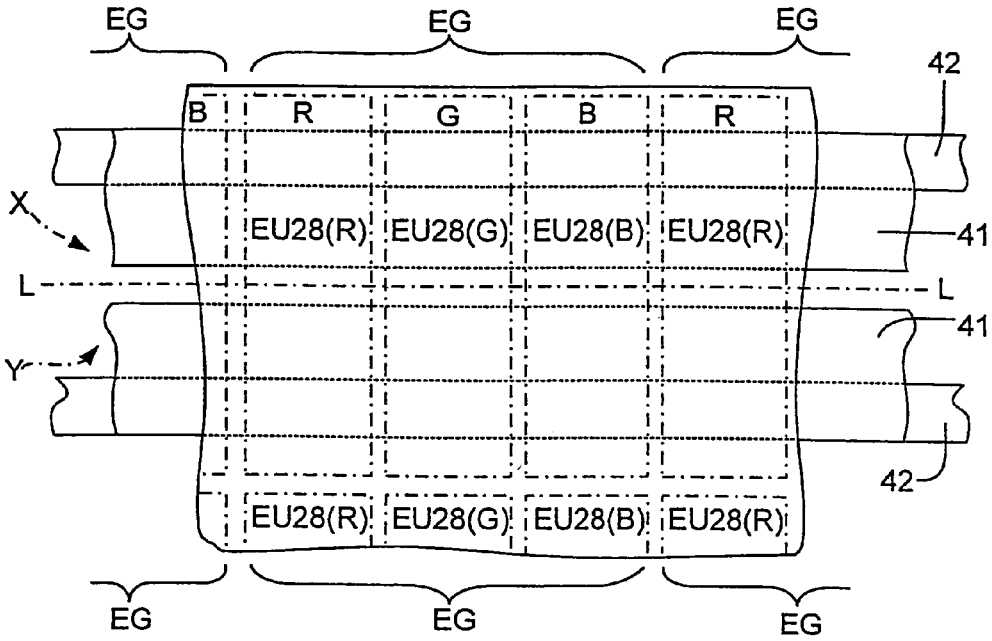
FIG. 1 schematically shows the basic construction of a full color surface discharge type plasma display device of the present invention.
Figure 2:
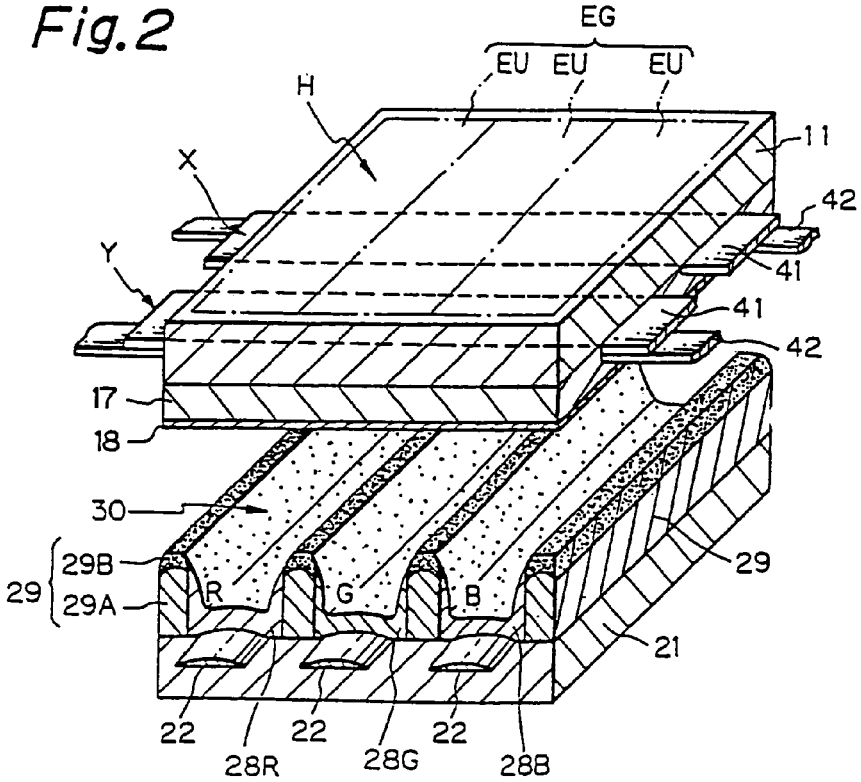
FIG. 2 is a perspective view of a full color flat panel ac plasma display device of the present invention.

In accordance with the present invention, with reference to FIGS. 1 and 2, the above problems are solved by a display device comprising pairs of lines of display electrodes X and Y; lines of address electrodes 22 insulated from the display electrodes X and Y and running in a direction intersecting the lines of display electrodes X and Y; areas of three phosphor layers 28R, 28G and 28B different from each other in luminescent color, facing the display electrodes and arranged in a successive order of the three phosphor layers along the-extending lines of the display electrodes X and Y; and a discharge gas in a space 30 between the display electrodes X and Y and the phosphors, such that the adjacent three phosphor layers EU of the three different luminescent colors 28R, 28G and 28B and a pair of lines of display electrodes X and Y define one image element EG of a full color display.

In this construction, only one display electrode pair, i.e., two display electrodes, is arranged in one image element. Accordingly, it is possible to reduce the size of the image elements. Also, it is possible to increase the area where display electrodes do not cover an image element so that the brightness of the display can be increased since metal electrodes interrupt illumination from the phosphors.

FIG. 1 is a plane view of an arrangement of display electrodes X and Y in an image element EG and FIG. 2 is a schematic perspective view of a structure of an image element.

Referring to FIG. 2, a three electrode type surface gas discharge ac plasma display panel is shown that comprises a glass substrate 11 on the side of the display surface H; a pair of display electrodes X and Y extending transversely parallel to each other; a dielectric layer 17 for an ac drive; a protecting layer 18 of MgO; a glass substrate 21 on the background side; a plurality of barriers extending vertically and defining the pitch of discharge spaces 30 by contacting the top thereof with the protecting layer 18; address electrodes 22 disposed between the barriers 29; and phosphor layers 28R, 28G and 28B of three primary colors of red R, green G and blue B.

The discharge spaces 30 are defined as unit luminescent areas EU by the barriers 29 and are filled with a Penning gas of a mixture of neon with xenon (about 1–15 mole %) at a pressure of about 500 Torr as an electric discharge gas emitting ultra-violet rays for exciting the phosphor layers 28R, 28G and 28B.

In FIG. 2, the barriers 29 are formed on the side of the substrate 21 but are not formed on the side of the substrate 11, which is advantageous in accordance with the present invention and described in more detail later.

Each of the display electrodes X and Y comprises a transparent conductor strip 41, about 180 μm wide, and metal layer 42, about 80 μm wide, for supplementing the conductivity of the transparent conductor strip 41. The transparent conductor strip 41 are, for example, a tin oxide layer and the metal layers 42 are, for example, a Cr/Cu/Cr three sublayer structure.

The distance between a pair of the display electrodes X and Y, i.e., the discharge gap, is selected to be about 40 μm and an MgO layer 18 about a few hundred nano meters thick is formed on the dielectric layer 17. The interruption of a discharge between adjacent display electrode pairs, or lines, L can be prevented by providing a predetermined distance between the adjacent display electrode pairs, or lines, L. Therefore, barriers for defining discharge cells corresponding to each line L are not necessary. Accordingly, the barriers may be in the form of parallel strips, not the cross lattice enclosing each unit luminescent area, as shown in FIG. 3, and thus, can be very much simplified.

The phosphors 28R, 28G and 28B are disposed in the order of R, G and B from the left to the right to cover the surfaces of the substrate 21 and the barriers 29 defining the respective discharge spaces there-between. The phosphor 28R emitting red luminescence is of, for example, (Y, Gd) B03:$EU^{2+}$, the phosphor 28G emitting green luminescence is of, for example, $Zn_2SiO_4$:Mn, and the phosphor 28B emitting blue luminescence is of, for example, $BaMgAl_{1\ 4}$ $0_{23}$: $Eu^{2+}$. The compositions of the phosphors 28R, 28G and 28B are selected such that the color of the mixture of luminescences of the phosphors 28R, 28G and 28B when simultaneously excited under the same conditions is white.

At an intersection-of one of a pair of display electrodes X and Y with an address electrode 22, a selected discharge cell, not indicated in the figures, for selecting display or non-display of the unit luminescent area EU is defined. A primary discharge cell, not indicated in the figures, is defined near the selected discharge cell by a space corresponding to the phosphor. By this construction, a portion, corresponding to each unit luminescent area EU, of each of the vertically extending phosphor layers 28R, 28G and 28B can be selectively illuminated and a full color display by a combination of R, G and B can be realized.

Referring to FIG. 1, respective image elements are comprised of three unit luminescent areas EU arranged transversely and having the same areas. The image elements advantageously have the shape of a square for high image quality and, accordingly, the unit luminescent areas EU have a rectangular shape elongated in the vertical direction, for example, about 660 μm×220 μm.

A pair of display electrodes are made corresponding to each image element EG, namely, one image element EG corresponds to one line L.

Accordingly, in comparison with the case of the prior art as shown in FIG. 3 where two lines L correspond to one image element EG, the number of the electrodes in an image element EG is reduced by half in the construction of the present invention as shown in FIGS. 1 and 2, as compared to the prior art of FIGS. 3 and 4.

If the area of one image element EG is selected to be the same as that of the prior art, the width of the display electrodes X and Y can be almost doubled. As the width of the display electrodes X and Y is larger, the reliability is increased since the probability of breaking the electrodes is reduced.

Further, the width of the transparent conductor strip 41 can be made sufficiently large, compared to the width of the metal layer 42 that is necessarily more than a predetermined width to ensure the conductivity over the entire length of the line L. This allows an increase in the effective area of illumination and thus the display brightness.

For example, in the arrangement of FIG. 3, the width of the display electrodes Xj and Yj is 90 μm, the gap between a pair of the display electrodes Xj and Yj is 50 μm, and the width of the unit luminescent area EUj, is 330 μm. The gap between a pair of display electrodes Xj and Yj of at least 50 μm is necessary to ensure a stable initiation of discharge and a stable discharge. A width of the display electrodes Xj and Yj of 90 μm is selected because a metal layer having at least a 70 μm width is necessary to ensure conductivity for a 21 inch (537.6 mm) line L or panel length. Moreover, the total width of the pair of display electrodes Xj and Yj and the gap therebetween should be not more than about 70% of the width of the unit luminescent area EUj, as determined in accordance with the present invention. Accordingly, in an image element EG having a total width of 330 μm×2=660 μm, the total width of four display electrodes Xj and Yj is 90 μm×4=360 μm and the total width of the four metal layers in the display electrodes Xj and Yj is 70 μm×4=280 μm. The total width of the metal layers is 70 μm×4=280 μm and the effective illumination area is (660 μm 280 μm)=380 μm, 58% of the image element.

In comparison with the above, in the construction as shown in FIGS. 1 and 2, if the total width of the image element EG is selected to be the same as above, i.e, 660 μm, the total width of the pair of display electrodes X and Y and the gap therebetween can be 460 μm, the gap between a pair of the display electrodes X and Y is 50 μm, and accordingly, the width of each of the display electrodes X and Y is 210 μm including the width of the metal layer 42 of 70 μm and the rest width of the transparent conductor strip 41 of 140 μm. The width of each display electrode of 210 μm is 233% of the width of the prior art of 90 μm. The total width of the metal layers 42 is only 70 μm×2=140 μm and the effective illumination area is (660 μm−140 μm).=520 μm, 79% of the image element, which is about 138%, compared to that of the prior art, which is 58%.

Of course, although the size of an image element is made the same in the above comparison, it is possible in the present invention for the size of an image element to be decreased without the risk of the display electrodes breaking and a very fine display can easily be attained.

Further, although the above is a so-called reflecting type panel in which the phosphor layers 28R, 28G and 28B are disposed on the background side glass substrate 21, the present invention may also be applied to a so-called transmission type panel in which the phosphor layers 28R, 28G and 28B are disposed on the display surface side glass substrate 11.

Referring back to FIG. 4, a gap of the discharge cells 77 between the two substrates 71 and 79 or the total height of the barriers 75 and 76 is generally selected to about 100 to 130 μm for alleviating the shock by ion bombardment during discharge. Accordingly, when one observes from the side of the display surface H of a plasma display panel in which the phosphor layer 78 is disposed only on the glass substrate 79, the view is disturbed by the barriers 75 and 76. Thus, the viewing angle of display of a panel of the prior art is narrow and it becomes narrower as the fineness of the display image elements becomes higher. Further, the surface area of the phosphor layer 78 in the unit luminescent area EUj, i.e., the substantial luminescence area, is small, which renders the brightness of display low even when viewed from the right front side of the panel.

To solve this problem, in accordance with the present invention, the phosphor layer is formed not only on the surface of one substrate facing the display electrodes but also on the side walls of the barrier. Further, on the surface of the one substrate, the phosphor layer is also formed on the address electrode, even if present.

In this construction, it is apparent that the viewing angle of display is widened since the phosphor layers on the side walls of the barriers contribute to the display and the luminescent area is enlarged by the phosphor covering the barriers and the address electrode.

Figure 7:
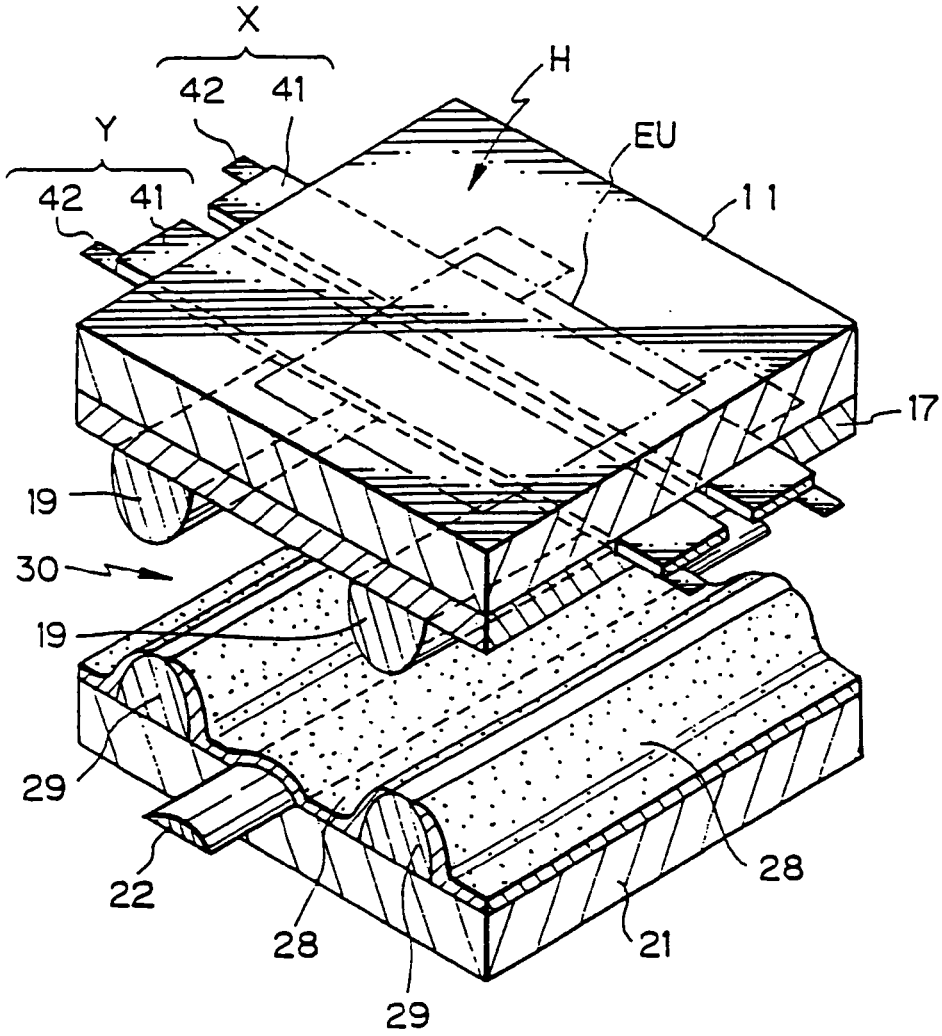
FIG. 7 is one perspective view of another full color flat panel ac plasma display device of the present invention.
Figure 8:
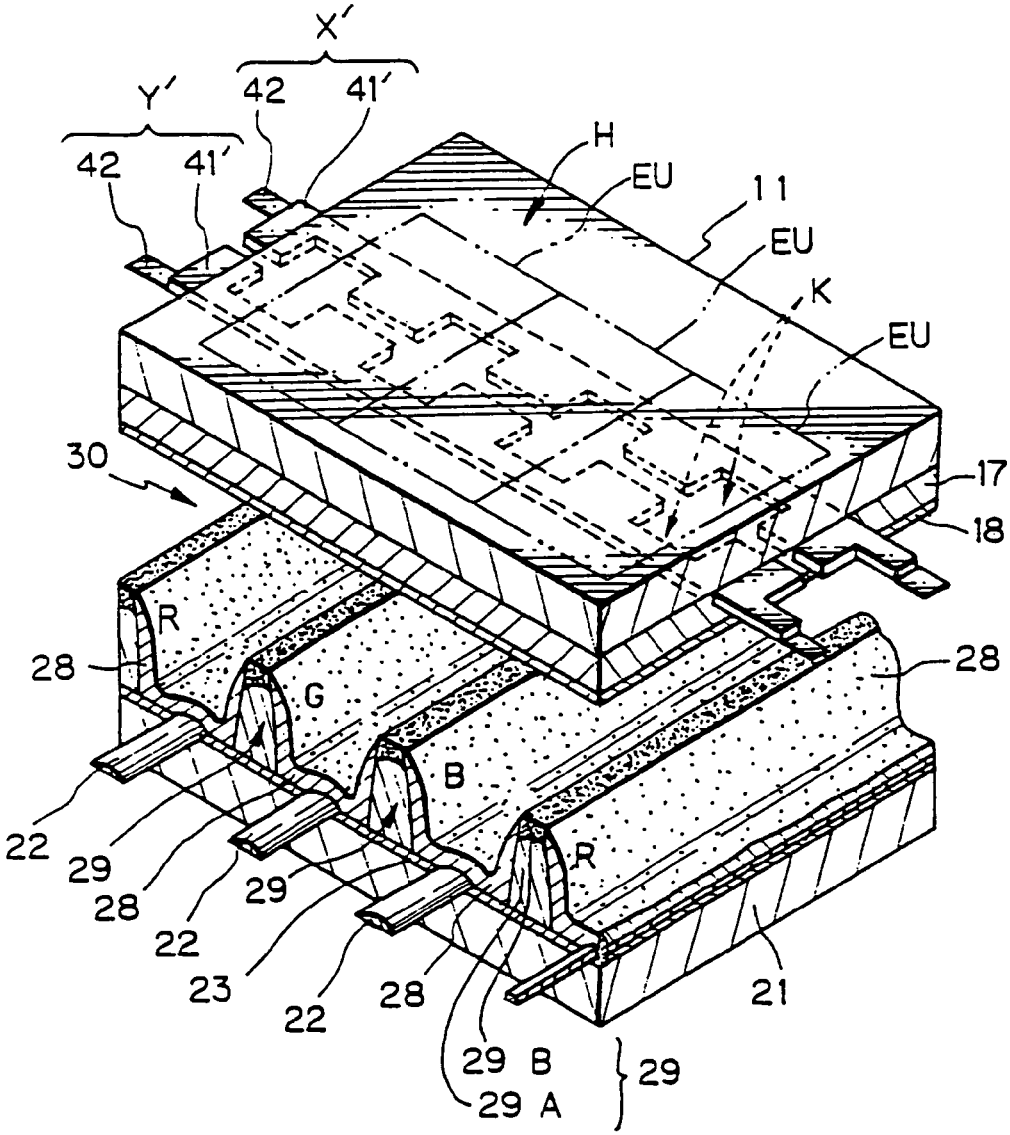
FIG. 8 is a second perspective view of another full color flat panel ac plasma display device of the present invention.

FIG. 7 shows another example of a plasma display panel according to the present invention which is very similar to that shown in FIG. 2 except that the barriers 19 and 29 are formed on both substrates 11 and 21, respectively. FIG. 8 shows a further example of a plasma display panel according to the present invention which is very similar to that shown in FIG. 2 except that the display electrodes have a particular shape. In FIGS. 7 and 8, the reference numbers denoting parts corresponding to the parts of FIG. 2 are the same as in FIG. 2.

In FIG. 7, the barriers 19 and 29 are made of a low melting point glass and correspond to each other to define the discharge cells 30, each barrier having a width of, for example, 50 μm.

In the gap between the barriers 29 on the substrate 21, address electrodes 22 having a predetermined width, for example, 130 μm, are disposed, for example, by printing and firing a pattern of a silver paste.

The phosphor layers 28 (28R, 28G and 288) are coated on the entire surface of the glass substrate 21 including the side walls of the barriers 29 except for a top portion of the barriers 29 for contacting the member of the substrate 21, more specifically, a portion for contacting the protecting layer 18 of MgO in FIGS. 2 and 7 and the barriers 19 in FIG. 7. Almost the entire surface of the unit luminescent area EU including the side walls of the barriers 29 and the surface of the address electrodes 22 are covered with the phosphor layers 28.

In the plasma display panel shown in FIG. 8, the display electrodes X' and Y' comprise transparent conductor strips 41' having cutouts K for localizing the discharge and strips of metal layers 42 having a constant width. The transparent conductor strips 41' are arranged with a predetermined discharge gap at a central portion of a unit luminescent area EU and larger widths at both end portions of the unit luminescent area EU to restrict the discharge so that discharge interference between the adjacent unit luminescent areas EU is prevented and, as a result, a wide driving voltage margin is obtained. The total width of the display electrodes X' and Y' and the gap therebetween is made to be not more than 70% of the width of the unit luminescent area EU or the pitch of the adjacent display electrodes.

On the rear glass substrate 21, an underlying layer 23, an address electrode 22, barriers 29 (29A and 298) and phosphor layers 28 (28R, 28G and 28B) are laminated or formed.

The underlying layer 23 is of a low melting point glass, and is higher than that of the barriers 29, and serves to prevent deformation of the address electrodes 22 and the barriers 29 during thick film formation by absorbing a solvent from pastes for the address electrodes 22 and the barriers 29. The underlying layer 23 also serves as a light reflecting layer by coloring, e.g., white by adding an oxide or others.

The address electrodes 22 are preferably of silver which can have a white surface by selecting suitable firing conditions.

The barriers 29 have a height almost corresponding to the distance of the discharge apace 30 between the two substrates 11 and 21 and may be composed of low melting point glasses having different colors depending on the portions. The top portion 298 of the barriers 29 has a dark color, such as black, for improving the display contrast and the other portion 29A of the barriers 29 has a light color, such as white, for improving the brightness of the display. This kind of barriers 29 can be made by printing a low melting point glass paste containing a white colorant, such as aluminum oxide or magnesium oxide, several times followed by printing a low melting point glass paste containing a black colorant and then firing both low melting point glass pastes together.

The phosphor layers 28 (R, G and B) are coated so as to cover the entire inner surface of the glass substrate 21 except for portions of the barriers 29 that are to make contact with the protecting layer 18 on the substrate 11 and portions nearby. Namely, the walls of the substrate 21 in the discharge space of the unit luminescent area EU, including the side walls of the barriers 29 and the address electrodes 22, are almost entirely covered with the phosphor layers 28. R, G and B denote red, green and blue colors of luminescence of the phosphor layers 28, respectively.

It is possible for an indium oxide or the like to be added to the phosphor layers 28 to provide conductivity in order to prevent stack of electric charge at the time of the selective discharge and make the drive easily and stable depending on a driving method.

In this embodiment of FIG. 8, the phosphor layers 28 cover almost the entire surface of the barriers 29, which have an enlarged phosphor area compared to that of the embodiment of FIG. 7, so that the viewing angle and the brightness of the display are improved.

Further, since the underlying layer 23 and the barriers 29A are rendered a light color, such as white, the light that is emitted toward the background side is reflected by these light color members so that the efficiency of the utilization of light is improved, which is advantageous for obtaining a high display brightness.

Figure 9:
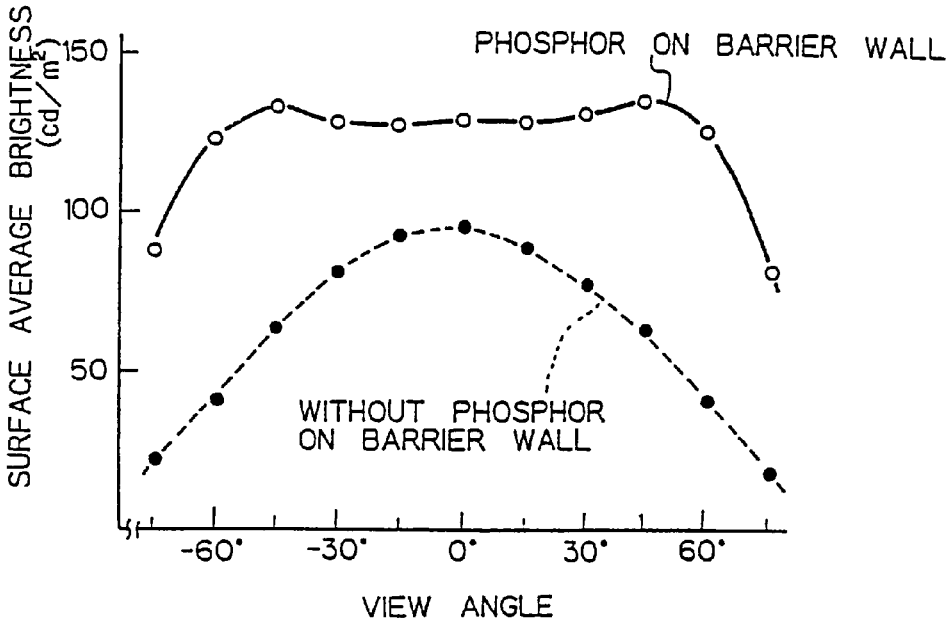
FIG. 9 is a first graph illustrating the brightness of display versus the view angle.

FIG. 9 shows the brightness of panels at various view angles. The solid line shows a panel A in which the phosphor layers 28 also cover the side walls 29 of the barriers and the broken line shows a panel B in which the phosphor layers 28 do not cover the side walls 29 of the barriers. The panels A and B have the same construction but do not have the same phosphor coverage. It is seen from FIG. 9 that at the right front side of the display surface H (view angle of 0°), the brightness of the panel A is about 1.35 times that of the panel B, and in a wide viewing angle of −60° to +60°, the brightness of the panel A is above or almost equal to that of the panel B obtained at the right front of the display surface H.

Figure 10:
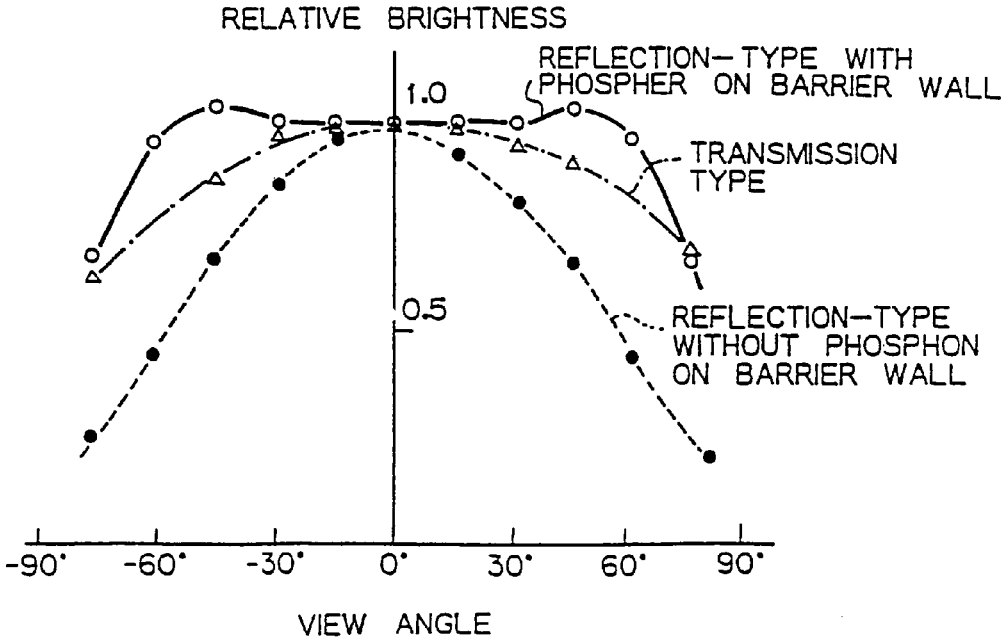
FIG. 10 is a second graph illustrating the brightness of display versus the view angle.

FIG. 10 shows the dependency of the display brightness on the view angle. The brightness of the display dependent on the view angle of a reflection type panel with phosphor layers on the side walls of the barriers, is shown to be even better than that of a transmission type panel, i.e., a panel in which the phosphor layers are disposed on a glass substrate of the side of the display surface EU.

As described before, it was found that the ratio of the total width of the display electrode pair X and Y including the width of the gap therebetween to the entire width of a unit luminescent area EU (hereinafter referred to as "electrode occupy ratio") should be not more than 70%, in order to avoid discharge interference between the adjacent lines L or display electrode pairs when there are no barriers between the adjacent lines L or display electrode pairs. Barriers between adjacent lines L or display electrode pairs are not necessary and can be eliminated if the electrode occupy ratio is selected to be not more than 70% of the entire width of a unit luminescent area EU.

Figure 11:
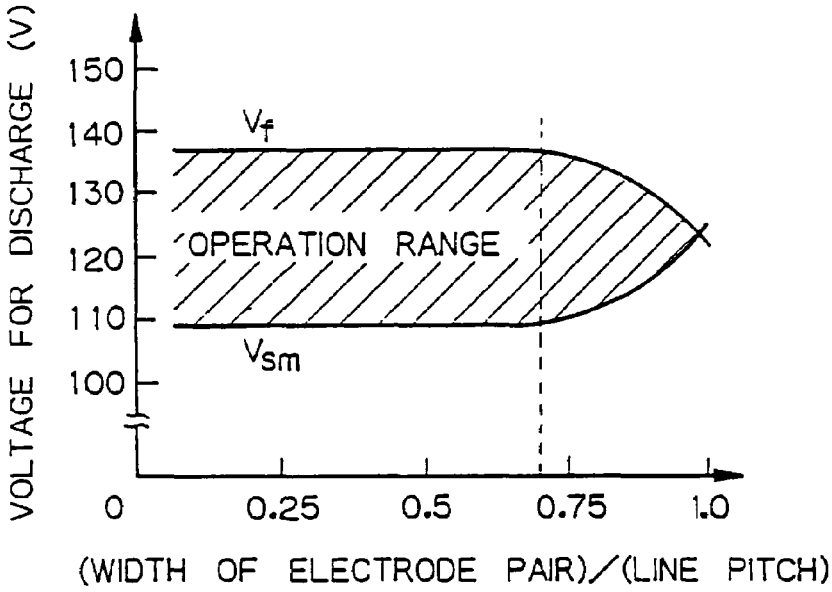
FIG. 11 is a first graph to illustrate how the stability of the discharge varies based on the structures of the barriers.

FIG. 11 shows the firing voltage V, and the minimum sustain voltage $V_{sm}$ when the electrode occupy ratio is varied. As seen in FIG. 11, if the electrode occupy ratio exceeds over about 0.7, the firing voltage V, is decreased and erroneous discharge between the adjacent lines of display electrodes may easily occur, but if the electrode occupy ratio is not more than about 0.7, the discharge is stable. If the electrode occupy ratio is not more than about 0.7, the minimum sustain voltage $V_{sm}$ is also stable. If the electrode occupy ratio is more than about 0.7, the minimum sustain voltage $V_{sm}$ is raised by discharge interference between adjacent lines L. Thus, a stable discharge operation or a wide operating margin can be obtained by selecting the electrode occupy ratio to be not more than about 0.7.

It is apparent that by eliminating barriers between adjacent unit luminescent areas defined along the extending direction of address electrodes, the effective display area and the brightness of the display can be improved and fabrication process becomes very easy.

Nevertheless, if the width of each of the display electrodes X and Y is less than about 20 μm, the electrodes tend to be broken and the electrode occupy ratio should preferably be not less than about 0.15.

Furthermore, in the embodiments of FIGS. 2 and 8, the discharge spaces are defined only by the barriers 29, in contrast to the embodiment of FIG. 7 where the discharge spaces are defined by the barriers 19 and 29 formed on both substrates 11 and 21. This permits the tolerance of the patterns of the barriers 29 to be enlarged significantly. For example, in the embodiment where the discharge spaces are defined by the barriers 19 and 29 formed on both substrates 11 and 21, if the unit luminescent area EU has a pitch of 220 μm, the tolerance of the patterns of each of the barriers 19 and 29 should be very severe, ±about 8 μm. In contrast, if the barriers 29 are made only on one side, the tolerance of the patterns thereof may be about some hundreds μm and the pattern alignment is significantly easily made and even a cheap glass substrate having significant shrinkage during firing may be used.

Figure 12:
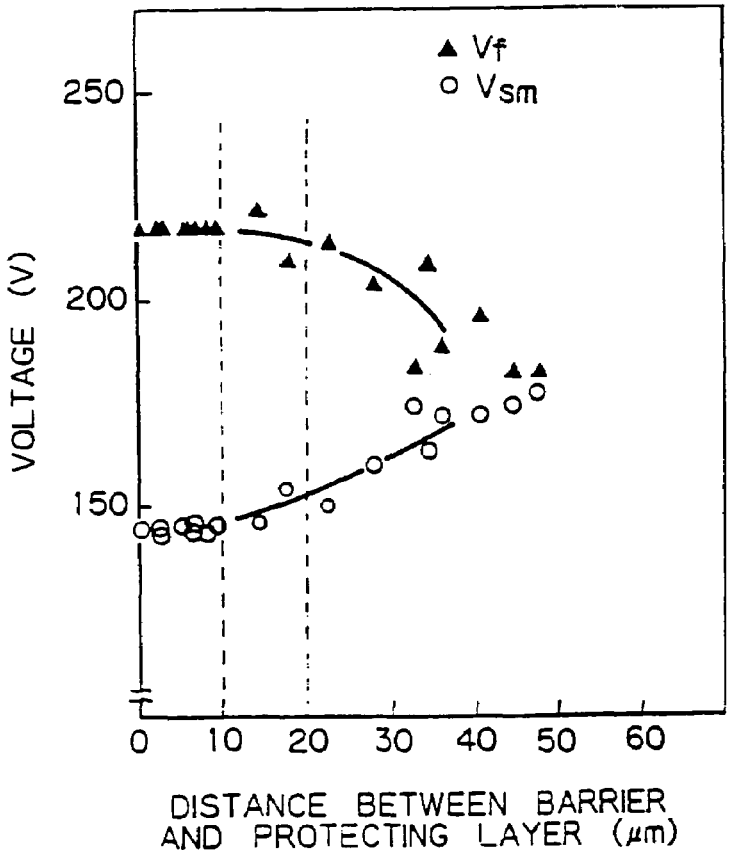
FIG. 12 is a second graph to illustrate how the stability of the discharge varies based on the structures of the barriers.

FIG. 12 shows the relationships between the firing voltage $V_f$ and, likewise, the minimum sustain voltage $V_{sm}$ and the distance between the top of the barriers 29 and the protecting layer 18 of the opposite side substrate 11. The distance between the top of the barriers 29 and the protecting layer 18 of the opposite side substrate 11 was determined by measuring the difference in the height of the barriers 29 by the depth of focus through a metallurgical microscope. In the measured panel, the barriers 29 had top portions having a width larger than 15 μm.

It is seen from FIG. 12 that if the distance between the top of the barriers 29 and the protecting layer 18 of the opposite side substrate 11 is more than 20 μm, it is difficult to obtain a wide margin. Accordingly, if the distance is not more than 20 μm, and preferably not more than 10 μm, a wide margin can be obtained. To attain this, it is preferred that the difference in height of the barriers be within ±5 μm.

Such a uniform height of barriers may be obtained by a method of forming a layer with a uniform thickness followed by etching or sand blasting the layer to form the barriers.

Figure 13:
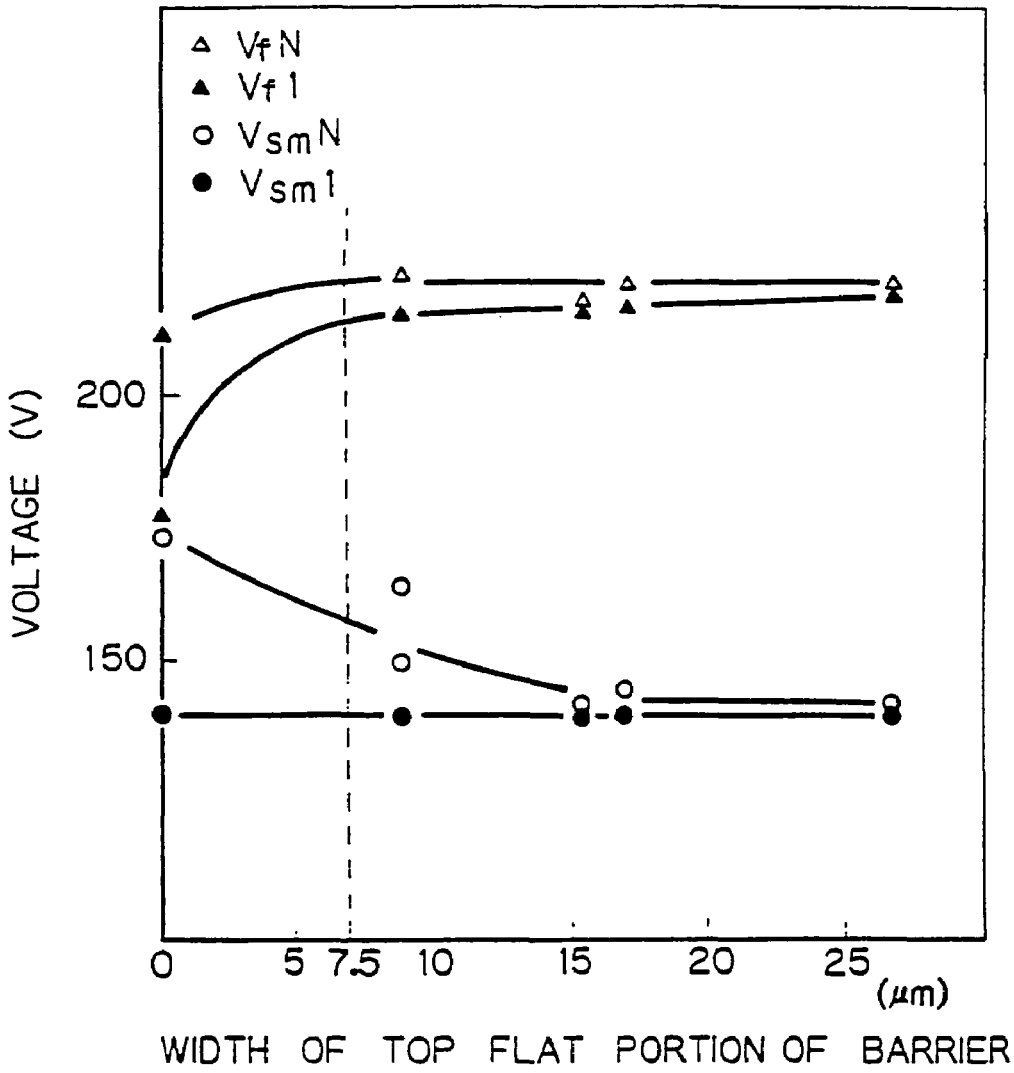
FIG. 13 is a third graph to illustrate how the stability of the discharge varies based on the structures of the barriers.

Further, it was found that the top portions of the barriers should preferably be made flat. FIG. 13 shows the relationship between the firing voltage $V_f$ and minimum sustain voltage $V_{sm}$, and the width of the top flat portions of the barriers. The barriers having flat top portions were made by the above etching method. In FIG. 13, $V_f(N)$ represents the maximum firing voltage, $V_f(1)$ represents the minimum firing voltage, $V_{sm}(N)$ represents the maximum of the minimum sustain voltage, and $V_{SM}(1)$ represents the minimum of the minimum sustain voltage. As seen in FIG. 13, if the width of flat top portions of the barriers is not lass than 7.5 μm, and more preferably not less than 15 μm, a wide margin can be obtained.

Such flat top portions of the barriers may be obtained by polishing the top portions of the barriers. This polishing also serves to obtain barriers with a uniform height.

In accordance with the present invention, the phosphor layers 28 are formed so as to cover the address electrodes 22 or A and side walls of the barriers so that the effective luminescent area is enlarged. In the conventional erase addressing method as shown in FIG. 5 for a panel as shown in FIG. 4, electric charges on the phosphors or the insulators are not sufficiently cancelled or neutralized and erroneous addressing may occur. Accordingly, a drive method for successfully treating the electric charges is required.

In accordance with an aspect of the present invention, this problem is solved by providing an ac plasma display panel in which the phosphor layers cover the address electrodes with an erase address type drive control system by which once all of the image elements corresponding to the display electrodes are written, an erase pulse is applied to one of the pair of the display electrodes and simultaneously an electric field control pulse for neutralizing the applied erase pulse is selectively applied to the address electrodes.

In this erase address system, a discharge between the address electrodes 22 and the display electrodes X and Y does not occur and therefore, wall charges that prevent the addressing are not stacked on the phosphor layers 28 existing between the address electrodes 22 and the discharge spaces 30.

In another embodiment, there is provided a write address type drive control system by which in displaying a line corresponding to a pair of the display electrodes, a line select pulse is applied to one of the pair of the display electrodes and simultaneously an electric field address pulse for writing is selectively applied to the address electrodes.

In a further embodiment, the above write address type drive control system is constituted such that in displaying a line corresponding to a pair of the display electrodes, all of the image elements corresponding to the display electrodes are once subject to writing and erasing discharges to store positive electric charges on the phosphor layers and negative electric charges on the dielectric layer.

In these write address type drive control systems, the stack of charges on the address electrodes 22 or A permits addressing by a selective discharge pulse PA having a low voltage height Va and by stacking positive charges on the address electrodes 22 or A prior to the addressing, the electric potential relationships between the respective electrodes during the display period CH can be made advantageous in preventing ion bombardment to the phosphor layers 28.

Figure 14:
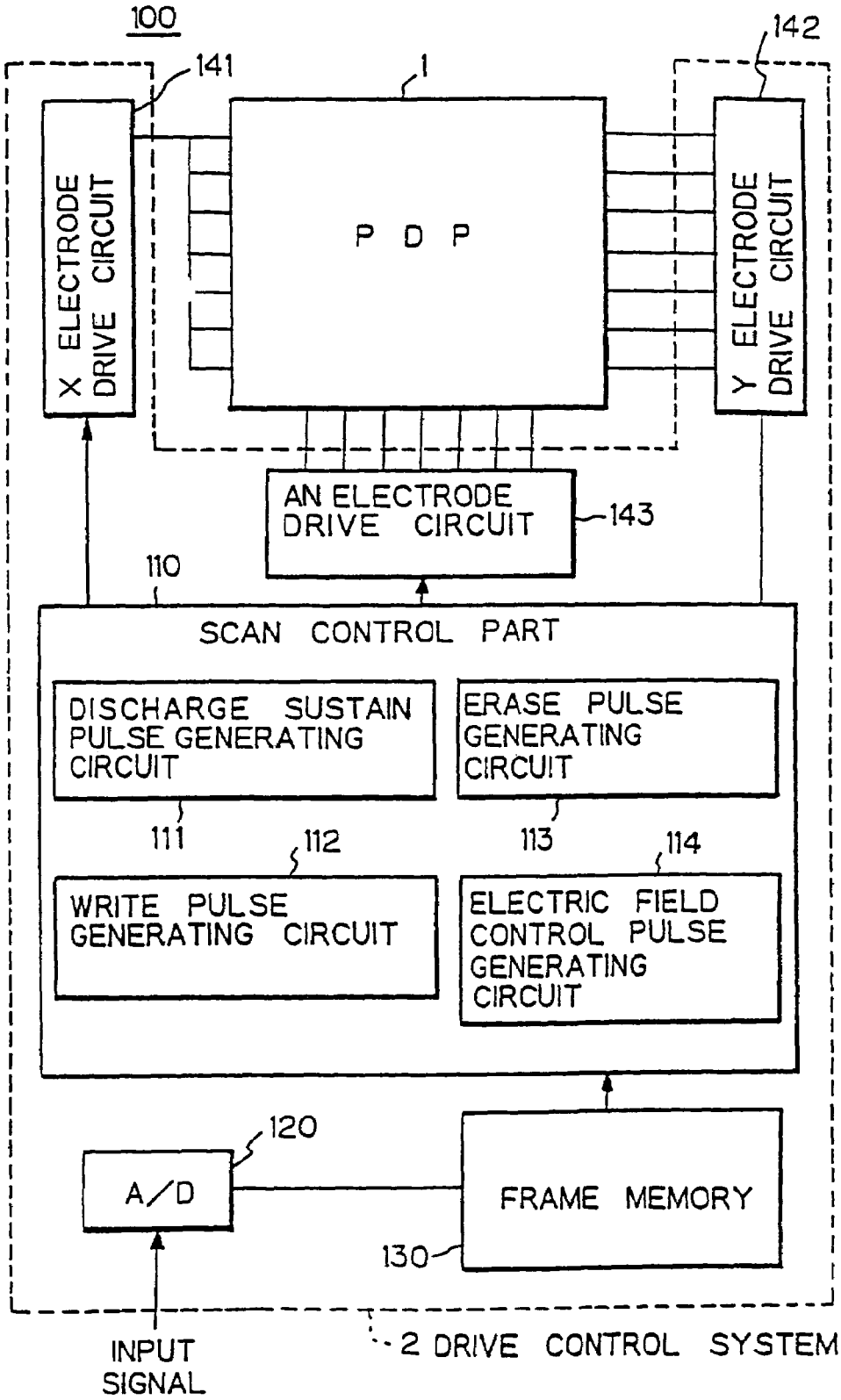
FIG. 14 is a block diagram of a full color flat panel ac plasma display device of an embodiment of the present invention.

FIG. 14 is a block diagram schematically showing the construction of an example of a plasma display device of the above embodiment. The plasma display device 100 comprises a plasma display panel 1 and a drive control system 2. The plasma display panel 1 and drive control system 2 are electrically connected to each other by a flexible printed board, not shown.

Figure 15:
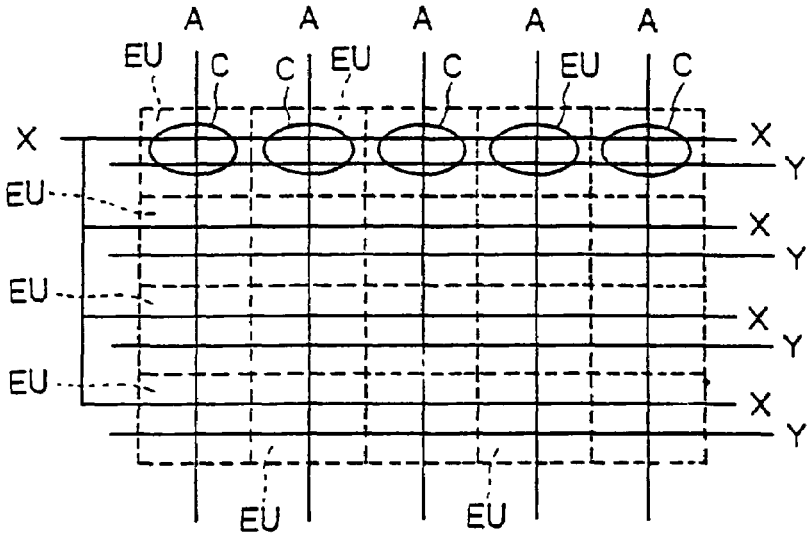
FIG. 15 schematically shows the arrangement of the electrodes of the plasma display panel, as in FIG. 14.

The plasma display panel 1 has a structure as shown in FIG. 2, 7 or 8. FIG. 15 schematically shows the electrode construction of the plasma display panel 1.

The drive control system 2 comprises a scan control part 110, an X electrode drive circuit 141 corresponding to the X display electrodes, a Y electrode drive circuit 142 corresponding to the Y display electrodes and an A electrode drive circuit 143 corresponding to the address electrodes A or 22, an A/D converter 120, and a frame memory 130.

The respective drive circuits 141 to 143 each comprise a high voltage switching element for discharge and a logic circuit for on off operation of the switching element. The drive circuits apply predetermined drive voltages, i.e., the discharge sustain pulse PS, the writing pulse PW, erasing pulse PD and electric potential control pulse PC to respective electrodes X, Y and A in response to a control signal from the scan control part 110.

The A/D convertor 120 converts the analog input signals, externally given as display information, to the image data of digital signals by quantitization. The frame memory 130 stores the image data for one frame output from the A/D converter 120.

The scan control part 110 controls the respective drive circuits 141 to 143 based on the image data for one frame stored in the frame memory 130, in accordance with the erase address system described below.

The scan control part 110 comprises a discharge sustain pulse generating circuit 111, a writing pulse generating circuit 112, an erasing pulse generating circuit 113, and an electric field control pulse generating circuit 114, which generate switching control signals corresponding to the respective pulses PS, PW, PD and PC.

Figure 16:
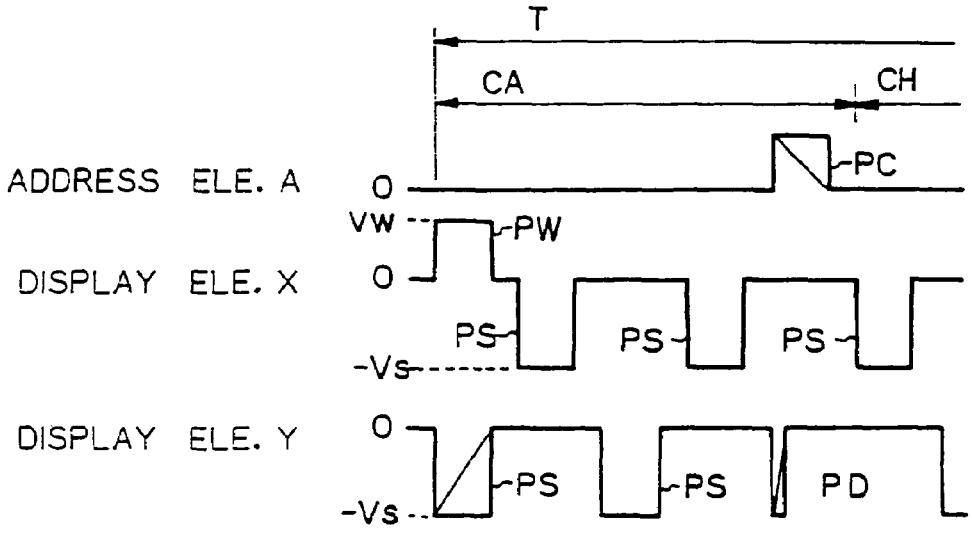
FIG. 16 shows the waveform of the addressing voltage of a full color flat panel ac plasma display device in an embodiment of the present invention.

In this plasma display device 100, the matrix display is performed by an erase address system in which selective erasing is carried out without selective discharge. FIG. 16 is the voltage waveform showing the driving method for the plasma display device 100.

For the plasma display device 100, in the initial address cycle CA in the line display period T, in the same manner as in the prior art as shown in FIG. 5, a discharge sustain pulse PS is applied to the display electrode Y and simultaneously a writing pulse is applied to the display electrode X. In FIG. 16, the inclined line in the discharge sustain pulse PS indicates that it is selectively applied to lines. By this operation, all surface discharge cells are made to be in a written state.

After the discharge sustain pulses PS are alternately applied to the display electrodes X and Y to stabilize the written states, and at an end stage of the address cycle CA, an erase pulse PD is applied to the display electrode Y and a surface discharge occurs.

The erase pulse PD is short in pulse width, 1 μs to 2 μs. As a result, wall charges on a line as a unit are lost by the discharge caused by the erase pulse PD. However, by taking a timing with the erase pulse PD, a positive electric field control pulse PC having a wave height Vc is applied to address electrodes A or 22 corresponding to unit luminescent areas EU to be illuminated in the line. In FIG. 16, the inclined line in the electric field control pulse PC indicates that it is selectively applied to the respective unit luminescent areas EU in the line.

In the unit luminescent areas EU where the electric field control pulse PC is applied, the electric field due to the erase pulse PD is neutralized so that the surface discharge for erase is prevented and the wall charges necessary for display remain. More specifically, addressing is performed by a selective erase in which the written states of the surface discharge cells to be illuminated are kept.

In this addressing, since no discharge occurs between the address electrodes A or 22 and the display electrodes X and Y, wall charges that prevent the addressing are not stacked on the phosphor layers 28 even if the phosphorlayers 28 that are insulative exist on the address electrodes A or 22. Accordingly erroneous illumination is prevented and an adequate display can be realized.

In the display period CH following the address cycle CA, the discharge sustain pulse PS is alternately applied to the display electrodes X and Y to illuminate the phosphor layers 28. The display of an image is established by repeating the above operation for all line display periods.

Figure 17:
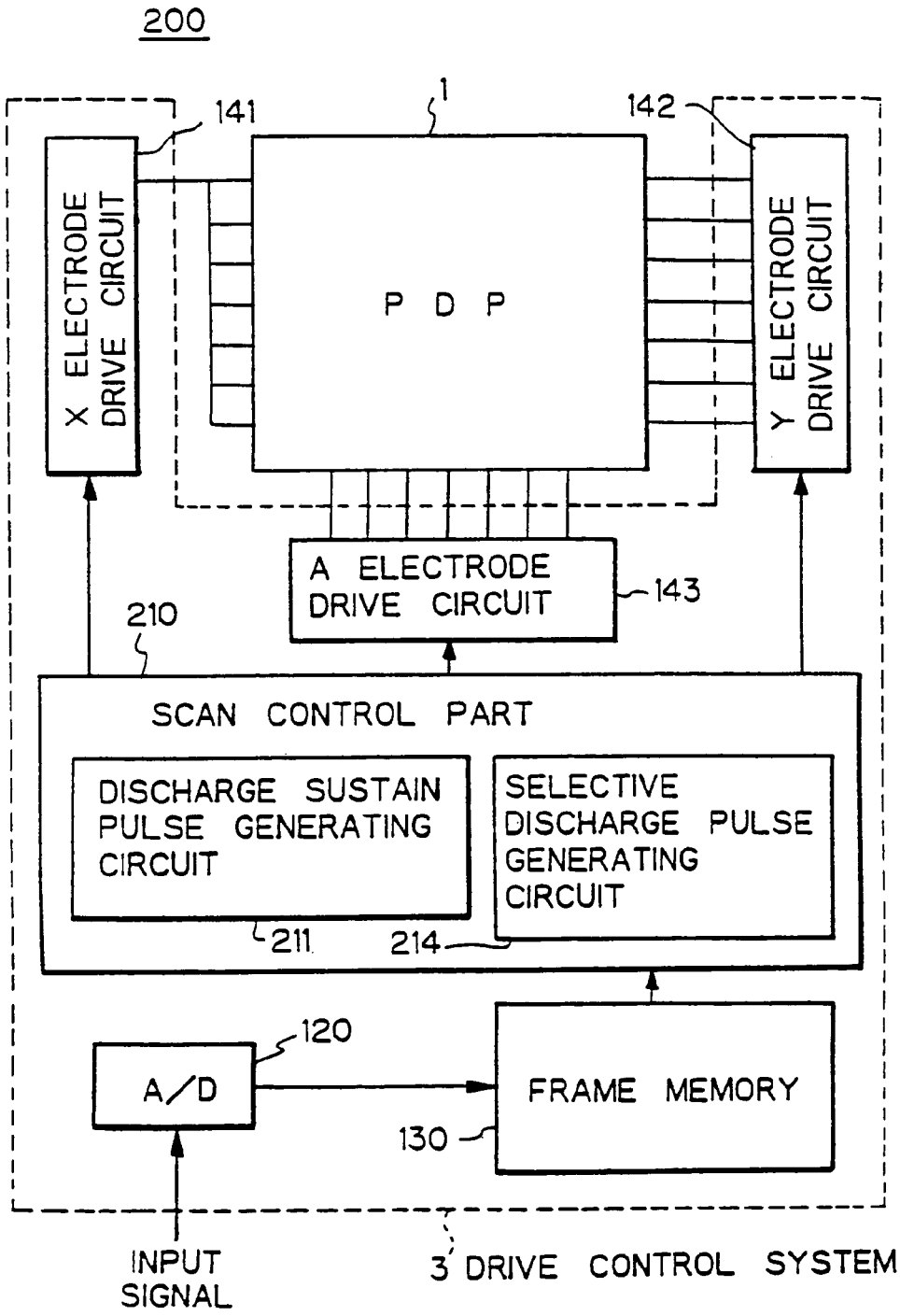
FIG. 17 is a block diagram of a full color flat panel ac plasma display device of another embodiment of the present invention.
Figure 18:
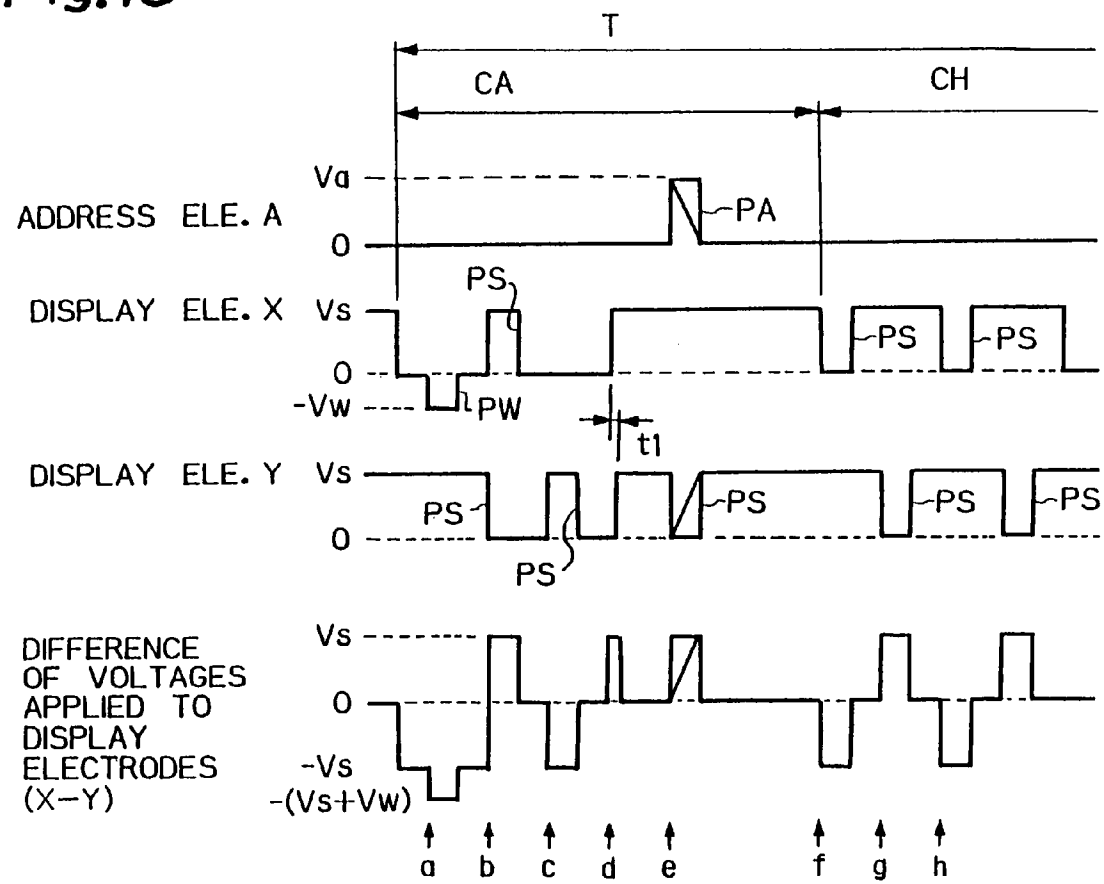
FIG. 18 shows the waveform of the addressing voltage of a full color flat panel ac plasma display device in another embodiment of the present invention.

FIG. 17 is a block diagram showing the construction of another example of a plasma display device 200; FIG. 18 shows the voltage waveform of a drive method of the plasma display device 200; and FIGS. 19A to 19H are schematic sectional views of the plasma display panel showing the charge stack states at the timing (a) to (h) of FIG. 18.

The plasma display device 200 comprises a plasma display panel as illustrated in FIG. 2, 7 or 8 and a drive control system 3 for driving the plasma display device 200.

The drive control system 3 comprises a scan control part 210 in which a discharge sustain pulse generating circuit 211 and a selective discharge pulse generating circuit 214 are provided.

In this plasma display device 200, the matrix display is performed by a write addressing system.

Referring to FIG. 18, in the display of a line, a discharge sustain pulse PS is selectively applied to the display electrode Y and a selective discharge pulse PA is selectively applied to the address electrodes A or 22 corresponding to unit luminescent areas EU to be illuminated in the line depending on the image. By this, opposite discharges between the address electrodes A or 22 and the display electrode Y or selective discharges occur, so that the surface discharge cells C are made into written states and the addressing finishes.

In this example, however, prior to the addressing, the charge stack state for alleviating the ion bombardment damage to the phosphor layers 28 has been formed in the manner as described below.

First, at a normal state, a positive discharge sustain voltage Vs has been applied to the display electrodes X and Y so that the pulse base potential of the display electrodes X and Y is made positive.

At an initial stage of the address cycle CA, a writing pulse PW is applied to the display electrode X so as to make the potential thereof a predetermined negative potential, −Vw.

Figure 19A:
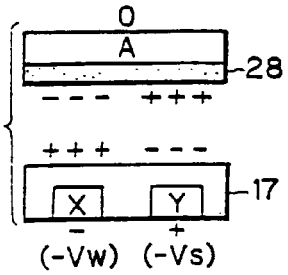
FIGS. 19A to 19H show the state of the electric charges at main stages in the operation in accordance with the waveform of the addressing voltage of FIG. 18.
Figure 19B:
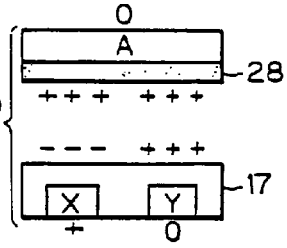

As a result, as shown in FIG. 19A, a positive charge, i.e., ions of discharge gas, having a polarity opposite to that of the applied voltage, is stacked on the portion of the dielectric layer 17 above the display electrode X (hereinafter referred to as "portion above the display electrode X") and a negative charge is stacked on the portion of the dielectric layer 17 above the display electrode Y (hereinafter referred to as "portion above the display electrode Y"). As a result of the relative electric field relationships of the address electrodes A or 22 and the display electrodes X and Y, a negative charge is stacked on a portion of the phosphor layers 28 that covers the address electrodes A or 22 and opposes the display electrode X and a positive charge is stacked on a portion of the phosphor layers 28 that opposes the display electrode Y Next the display electrode X is returned to the pulse base potential and the display electrode Y is made to be at the ground potential, i.e., zero volts. Namely, a discharge sustain pulse PS is applied to the display electrode Y. At this time, as shown in FIG. 19B, the polarities of the charges of the portions above the display electrodes X and Y are reversed by the surface discharge and the charge on the portion of the phosphors 28 above the address electrode A or 22 that opposes the display electrode X is reversed to positive.

Figure 19C:
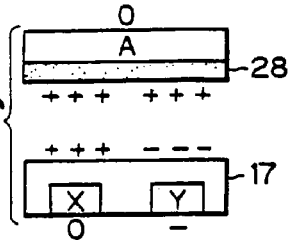

Then, after a discharge sustain pulse PS is applied to the display electrode X, the display electrode Y is returned to the pulse base potential to reverse the polarities of the charges on the portions above the display electrodes X and Y, as shown in FIG. 19C.

While a discharge sustain pulse PS is applied to the display electrode X or the display electrode X is the ground potential, a discharge sustain pulse PS is also applied to the display electrode Y and the display electrodes X and Y are returned to the pulse base potential in this order with a very short timing difference (t) of about 1 μs. As a result, a surface discharge occurs at the time when the display electrode X is returned to the pulse base potential, but after the very short time (t); the display electrodes X and Y attain the same potential; and the surface discharge immediately stops so that the charges on the portions above the display electrodes X and Y are lost.

Figure 19D:
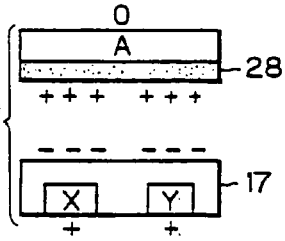
Figure 19E:
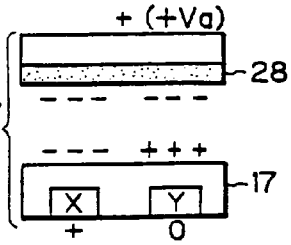

Nevertheless, then, since the pulse base potential is positive and a potential difference appears between the display electrodes X and Y and the address electrodes A or 22, a negative charge is uniformly stacked on the portions above the display electrodes X and Y and a positive charge is uniformly stacked on the portions above the address electrodes A or 22, as shown in FIG. 19D. In this state, the cells are in the erased state.

In this way, the charge stack state is formed for all surface discharge cells C corresponding to one line. At an end stage of the address cycle CA, a surface discharge occurs between the address electrodes A or 22 and the display electrode Y As a result of the opposite discharge, a positive charge is stacked on the portion above the display electrode Y and negative charges are stacked on the portion above the display electrode X and on the portions above the address electrodes A or 22.

In the following display cycle CH, a discharge sustain pulse PS is alternately applied to the display electrodes X and Y to illuminate the phosphor layers 28, during which the surface discharge occurs at every instance when one of the display electrodes X and Y becomes a negative potential to the pulse base potential, and at the time of generating the surface discharge, the address electrodes A or 22 in the state of capacitor coupling with the display electrodes X and Y become a positive potential relative to the negative potential of the display electrodes X and Y. As a result, movement of positive charges, i.e., ions, toward the address electrodes A or 22 is prevented so that the ion bombardment to the phosphors 28 is alleviated.

Figure 19F:
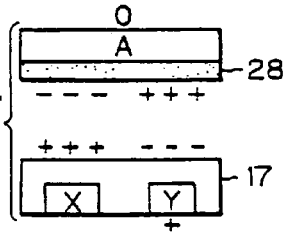
Figure 19G:
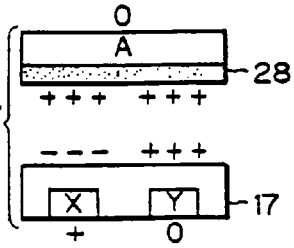
Figure 19H:
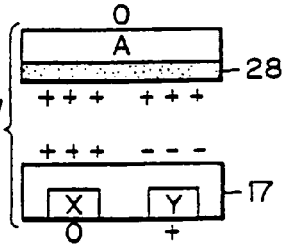

In the display cycle CH, the polarities of the charges on the portions above the display electrodes X and Y and the address electrodes A or 22 are changed as shown in FIGS. 19F to 19H.

In the write address system, since the address finishes by the discharge at a rising edge of the selective discharge pulse PA, in contrast to the erase address system where the address finishes by the self-erase discharge immediately after the selective discharge pulse PA, disadvantageous effects of the stack of charges on the portions above the address electrodes A or 22 do not appear and the address is stabilized even by the wall charges when the selective discharge pulse PA has a voltage height Va that is low.

The full color display can be attained by performing the above operation to each of the three primary color luminescent areas EU. The graded display can be attained by adequately selecting the number of the surface discharge during respective divided periods.

In the above embodiments, the discharge can be stabilized even when the phosphor layers 28 are formed to cover the address electrodes A or 22 and thus improvement of the brightness of display and the viewing angle can be attained. The results are shown in FIGS. 9 and 10.

The phosphor layers are typically coated on a substrate by a screen printing method, which is advantageous in productivity compared to the photolithography method and effectively prevents inadvertent mixing of different color phosphors. Conventionally, the typical phosphor paste contains a phosphor in an amount of 60 to 70% by weight and a square squeezer is used at a set angle of 90°.

Nevertheless, in a preferred embodiment of the present invention, the phosphor layers 28 are coated not only on the surface of a substrate 21 but also on side walls of barriers 29 having a height of, for example, about 100 μm, which necessitates the dropping of a phosphor paste from a screen, set at a height of about 100 μm above the surface of the substrate 21, onto the surface of the substrate 21 and makes a uniform printing area and thickness difficult. The nonuniform printed area and thickness of the phosphors degrade the display quality, such as causing uneven brightness or color tones, and make the discharge characteristic unstable.

Figure 20:
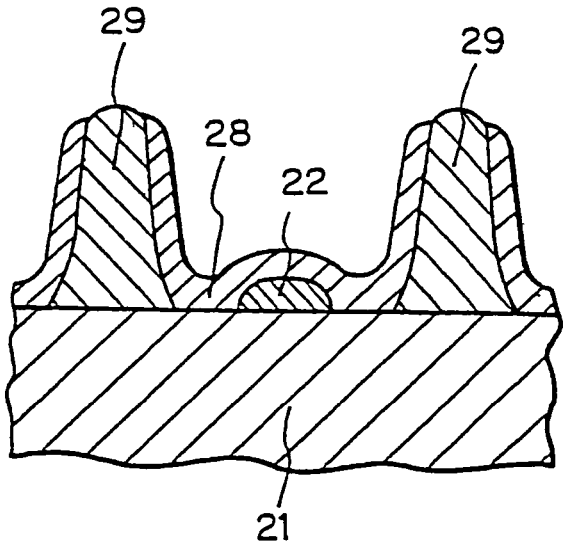
FIG. 20 shows an ideal coverage of a phosphor layer on barriers and a substrate.

FIG. 20 shows an ideal coating, i.e., the uniform coating of a phosphor layer 28 on the side walls of barriers 29 and on the substrate 21 and the address electrode 22.

The present invention solves this problem by a process comprising forming barriers on a substrate, screen printing phosphor pastes so as to fill the cavity formed between the barriers on the substrate with the phosphor pastes and then firing the phosphor pastes so as to reduce the volume of the phosphor pastes, forming recesses between the barriers on the substrate, and forming phosphor layers covering, almost entirely, the side walls of the barriers and the surface of the substrate. In this process, the amount of the filled phosphor pastes is determined by the volume of the cavity between the barriers on the substrate and is therefore constant. Thus, a uniform printing or coating can be made.

Figure 21:
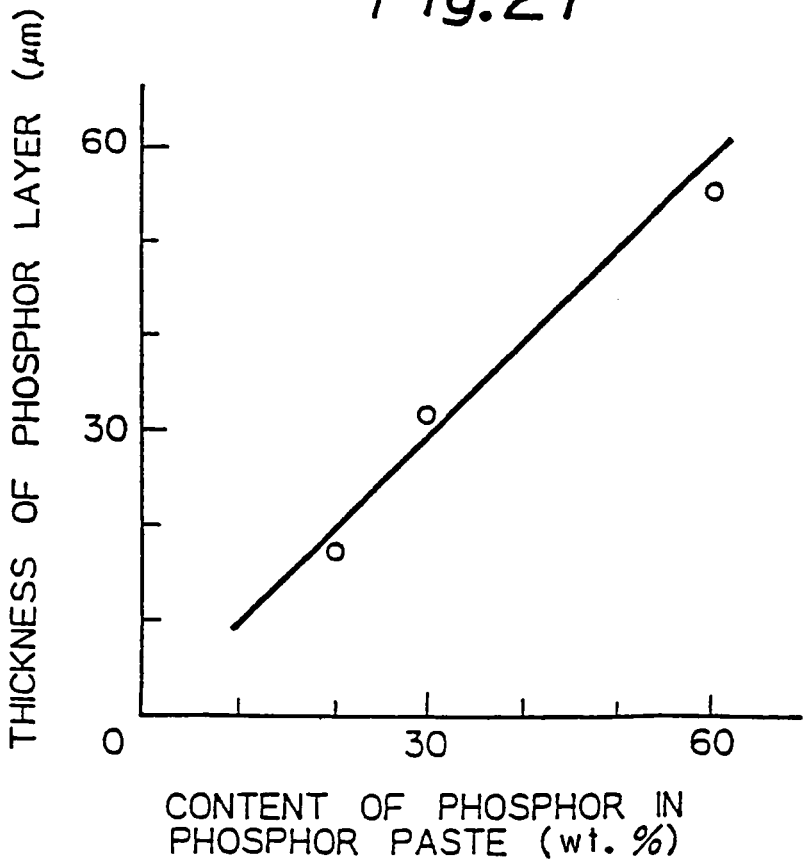
FIG. 21 shows the relationship between the thickness of the phosphor layer and the content of phosphor in a phosphor paste.

The thickness of the phosphor layer obtainable after firing is almost in proportion to the content of the phosphor in the phosphor paste, as shown in FIG. 21. On the other hand, the brightness of the display is increased as the thickness of the phosphor layer is thickened up to about 60 μm and a practically adequate brightness is obtained by a thickness of the phosphor layer of about 10 μm or more. On the other hand, as the thickness of the phosphor layer is increased, the selective discharge initialization voltage is also increased and if the thickness of the phosphor layer is over 50 μm, selective discharge becomes difficult in a drive voltage margin. Accordingly, the thickness of the phosphor layer is preferably 10 to 50 μm. This suggests that a phosphor paste having a content of a phosphor of 10 to 50% by weight be used.

Figure 22A:
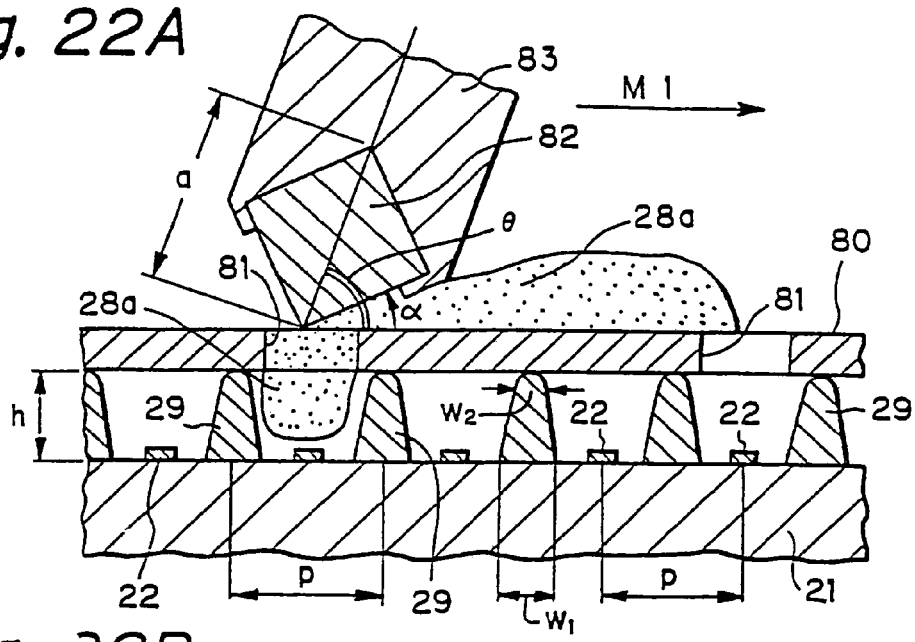
FIGS. 22A to 22C are cross-sectional views, used as an aid for understanding the main steps of forming a phosphor layer in a preferred embodiment of the present invention.
Figure 22B:
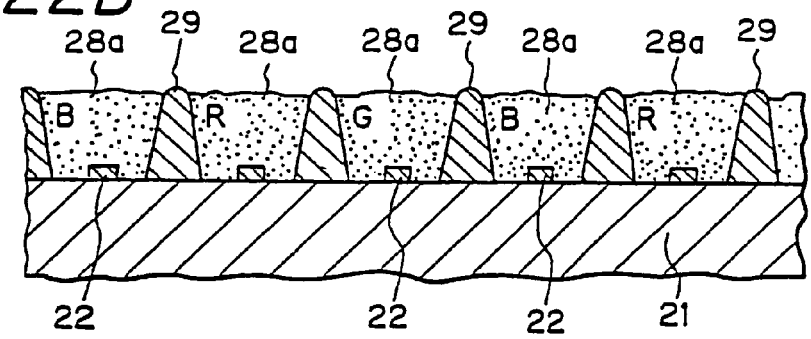
Figure 22C:
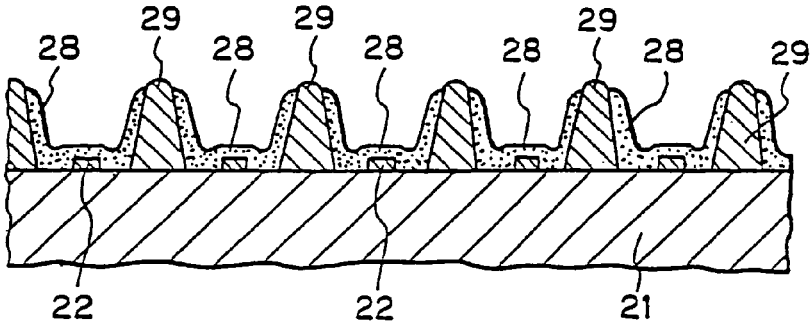

Referring to FIGS. 22A to 22C, first, on a glass substrate 21, address electrodes 22 of, e.g., silver about 60 μm thick and barriers 29 of a low melting point glass about 130 μm high are formed by the screen printing method, respectively. Here, for example, a screen mask in which openings having a width, for example, about 60 μm are arranged at a constant pitch (p), for example, 220 μm is used for printing a silver paste and a glass paste to form the address electrodes 22 and the barriers 29. In this case, the address electrodes 22 would have a width of about 60 to 70 μm and the barriers 29 would have a bottom width ($w_1$) of about 80 μm and a top width ($w_2$) of about 40 μm.

As shown in FIG. 22A, a screen 80, in which openings 81 halving a predetermined width are formed at a pitch triple the pitch (p) is arranged over the glass substrate 21 so as to contact the tops of the barriers 29 and adequately align the glass substrate 21.

Then a phosphor paste 28*a* comprising a phosphor having a predetermined luminescent color, for example, red, and a vehicle is dropped through the openings 81 into the space between the barriers 29. The used phosphor paste 28*a* has a content of phosphor of 10 to 50% by weight, in order to make the thickness of the phosphor layer 28 not more than 50 μm. The vehicle of the phosphor paste 28*a* may comprise a cellulose or acrylic resin thickener and an organic solvent such as alcohol or ester.

In addition, the phosphor paste 28*a* is pushed as much as possible toward the space between the barriers 29, in order to substantially fill the space. To attain this, a square squeezer, or squeegee, 82 is used and the set angle θ is set to 70 to 85°.

The square squeezer 82 is, for example, a hard rubber in the form of a bar having a rectangular and usually square cross section attached to a holder 83. A practical square squeezer 82 has a length (d) of the diagonal line in the cross section of about 10 to 15 mm.

The set angle θ of the square squeezer 82 is an angle formed by a line connecting the contact point and the center of the square squeezer 82 with the surface of the screen mask 80.in the direction of movement of the square squeezer 82 from the contact point, when the square squeezer 82 makes contact with the screen mask 80 at a point and moves in the direction of the arrow M1 while maintaining contact. When the set angle θ is 70° to 85°, a cross angle of the surface of the screen mask 80 and the surface facing the screen mask 80 of the square squeezer 82 is 25° to 40°, which is smaller than the conventional value of a=45° when the set angle θ is conventionally set to θ=90°. As a result, a force applied to the phosphor paste 28*a* by the square squeezer 82 is increased and a larger amount of the phosphor paste 28*a* can be extruded from the openings 81 into the spaces between the barrier, than is done conventionally.

Then, the other phosphor pastes, for green, (G) and blue (B) luminescences, are also filled in the predetermined spaces between the barriers 29 in order. The phosphor pastes have a content of phosphor of 10 to 50% by weight. Thus, all spaces between the barriers 29 are filled with predetermined phosphor pastes 28*a* (R, G and B), as shown in FIG. 22B.

The phosphor pastes 28*a* (R, G and B) are then dried and fired at a temperature of about 500 to 600° C. Thereby, the vehicle evaporates and the volumes of the phosphor pastes 28*a* are decreased significantly, so that the phosphor layers 28 having almost ideal forms as shown in FIG. 22C are obtained.

Of course, the content of the phosphor in the phosphor paste 28*a* may be adequately selected depending on the volume of the space between the barriers, the area of the inner surface of the substrate and barrier side wall surfaces surrounding and defining the space, the desired brightness and discharge characteristics, and other conditions.

Figure 23:
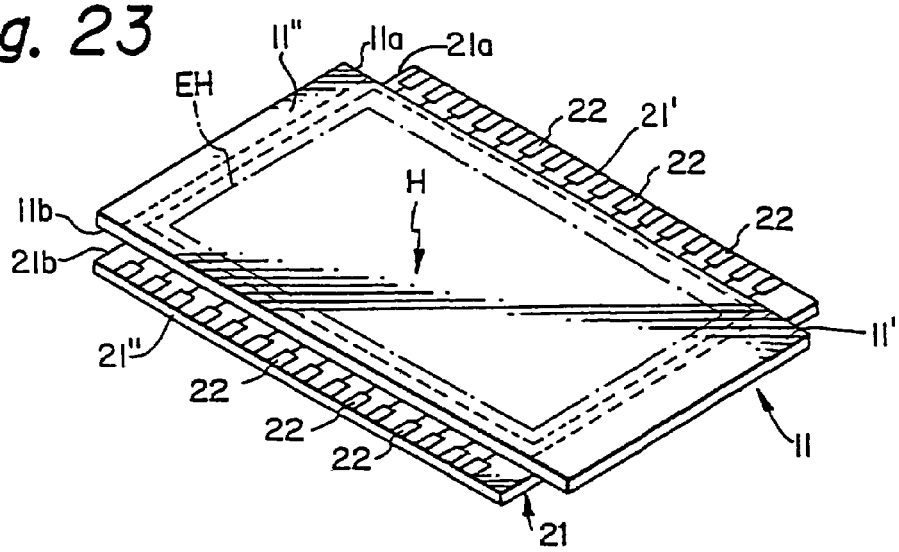
FIG. 23 is a perspective view of a flat panel ac plasma display device.

FIG. 23 is a perspective view of a plasma display panel in which H denotes the display surface, EH denotes the display area or discharge area, 11 and 21 denote the glass substrates, and 22 denotes the address electrodes. The display electrodes X and Y are similarly formed but not shown. After the predetermined elements are formed thereon, the glass substrates 11 and 21 are faced (i.e., disposed in facing, or opposed, relationship) and assembled together, sealed along the periphery; evacuated inside and filled with a discharge gas. This panel is electrically connected with an external drive circuit, not shown, through a flexible printed board or the like, not shown. The ends of the respective electrodes are enlarged and each of the glass substrates 11 and 21 extends at opposite ends 11', 11" and 21', 21" thereof from the opposite sides 21*a*, 21*b* and 11*a*, 11*b*, respectively, of the other one of the substrates, so that the enlarged portions of the electrodes are disposed on the extended substrate portions for connecting with outer leads.

Figure 24A:
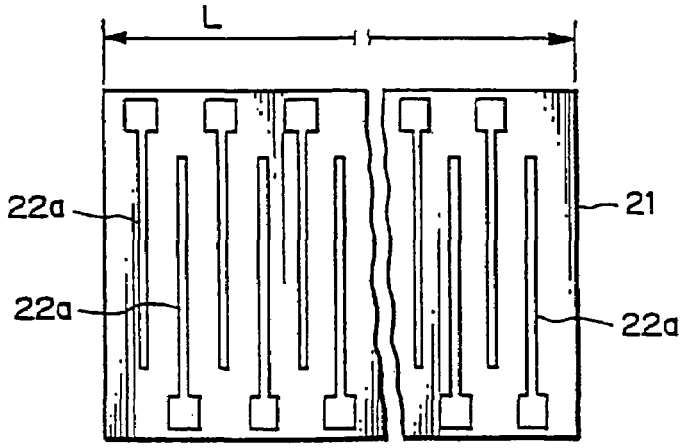
Fig. 24A PRIOR ART
FIGS. 24A and 24B are planar views, used as an aid for understanding the steps of forming address electrodes and barriers on a glass substrate in the prior art.
Figure 24B:
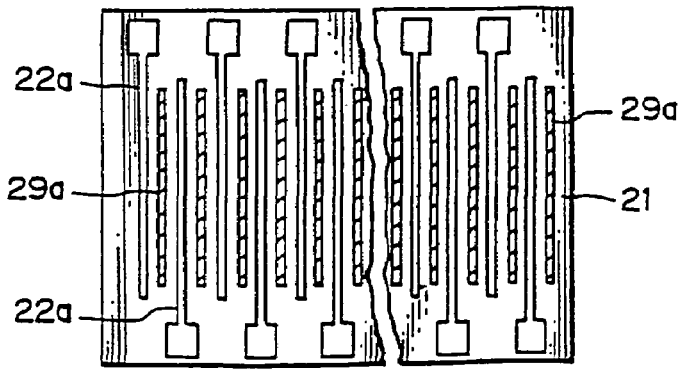
Fig. 24B PRIOR ART

Now referring to FIGS. 24A and 248, the address electrodes 22 and barriers 29 on the glass substrate 21 are typically formed in a process comprising the steps of first, printing patterns 22*a* of the address electrodes of, e.g., a silver paste through a screen printing step, second, repeatedly printing patterns 29*a* of the barriers of, e.g., a glass paste, until forming a predetermined thickness through a screen printing step, and then firing the patterns 22*a* and 29*a* at the same time, i.e., simultaneously. The patterns 22*a* of the silver paste, instead, may be fired before the printing of the patterns 29*a* of the glass paste.

In this process, it is difficult to make an alignment of the address electrodes 22 and barriers 29 because of size dispersion of the printing mask and it is difficult to manufacture a very fine and large-sized panel.

Printing masks have a size dispersion of mask patterns caused by the limitation of mask manufacturing processes. For example, if the address electrodes 22 have a length L of 40 cm, the size dispersion of the mask patterns, from one and strip pattern to the other and strip pattern, may be ±about 50 Am. The total of these size dispersions of the printing masks for the address electrodes 22 and the barriers 29 may be 100 μm at maximum. The size dispersion becomes larger as the printing mask becomes larger.

Accordingly, if one end of the glass substrate 21 is used as the alignment reference, the difference of the pitch of the printing mask for the barriers 29 is added with the difference of the pitch of the printing mask for the address electrodes 22 at the other end of the glass substrate 21 and accordingly, the alignment between the address electrodes 22 and the barriers 29 is degraded significantly. Therefore, the alignment of the printing masks is finely adjusted so as to obtain a uniform distribution of the patterns, but it is not easy to avoid overlaps between the address electrodes 22 and the barriers 29. If the size dispersion of the patterns is large, the fine adjustment of the masks cannot be effective.

The present invention solves the above problem by a process of printing a material for main portions of the address electrodes with a printing mask, separately printing a material for and portions of the address electrodes for connecting with outer leads, and than printing a material for the barriers with the same printing mask.

Since the patterns of the main portions of the address electrodes and the patterns of the barriers are printed using the same printing mask, the pitches of the main portions of the address electrodes and the corresponding pitch of the barriers cannot be different, irrespective of the size dispersion of the patterns of the printing mask. Accordingly, the main portions of the address electrodes and the barriers can be easily aligned by simply parallel shifting the printing mask a certain distance.

Figure 25A:
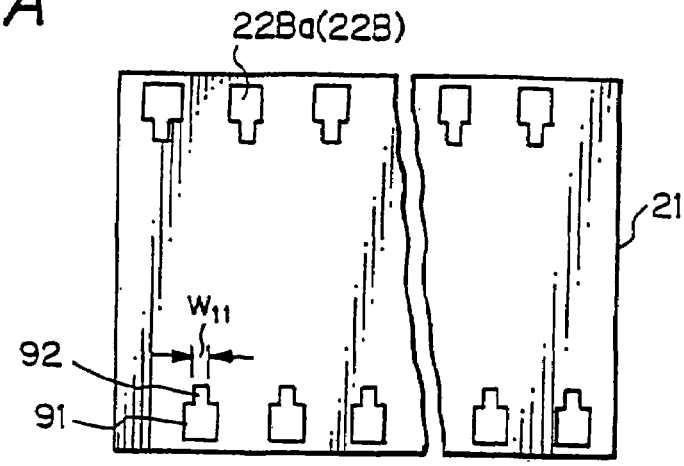
FIGS. 25A to 25E are planar and segmented views, used as an aid for understanding the steps of forming address electrodes and barriers on a glass substrate in a preferred embodiment of the present invention.

Now referring to FIG. 25A, silver paste patterns 22B*a* for connecting portions 22B of address electrodes 22 are printed on a glass substrate 21 with a printing mask, not shown. The connecting portions 22B of address electrodes 22 are disposed outside the display area EH (FIG. 23) and comprise, for example, enlarged portions 91 for external connection and reduced portions 92 for connecting with the main portions of the address electrodes 22, as shown in FIG. 25A.

In this example, the connecting portions 22B are arranged outside the display area EH, for alternate ones of the address electrodes 22 on respective, opposite sides of the substrate 21 (22). That is, the printing mask has such a pattern that the connecting portions 22B are arranged alternately on respective, opposite sides at a pitch of double the pitch of the address electrodes 22. The width $w_{11}$ of the reduced portions 92, at an and of the connecting portions 22B for connecting with the main portions 22A of the address electrodes 22, is made larger than the width $w_{10}$ of the main, or enlarged, portions 22A of the address electrodes 22, thereby making alignment of these portions 92 and 22A easy.

Figure 25B:
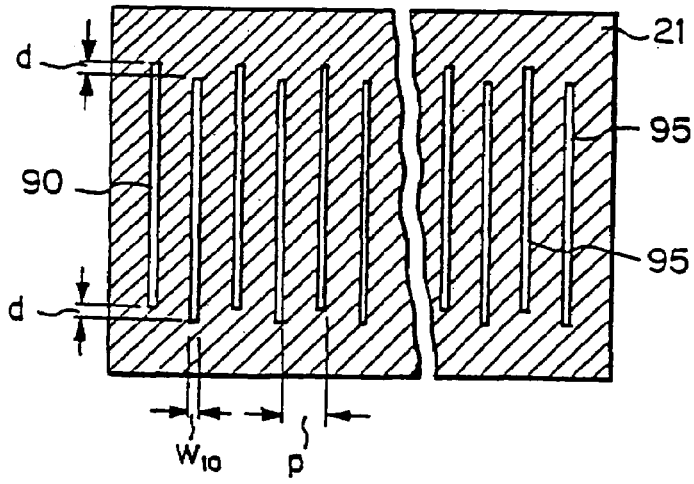
Figure 25C:
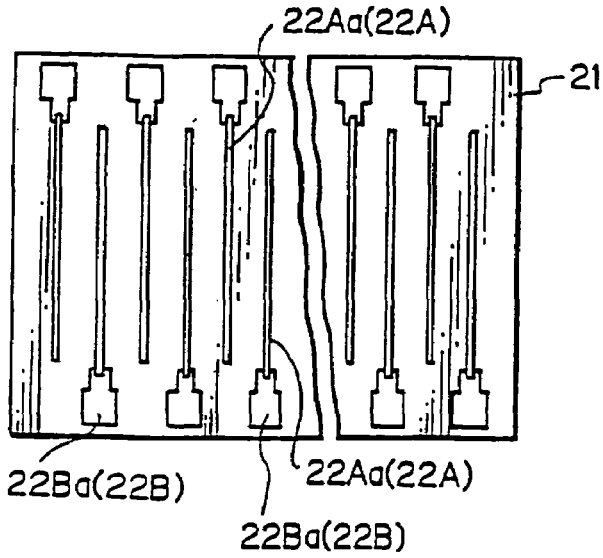

After the silver paste 22B*a* is dried, silver paste patterns 22A*a* for the main portions 22A of the address electrodes 22 are printed, using a printing mask as shown in FIG. 25B, on the glass substrate 21 so as to partially overlap with the silver paste patterns 22B*a*, as shown in FIG. 25*c*.

The main portions 22A of the address electrodes 22 include corresponding, main discharge portions, defining the discharge cells, in the display area EH and minor portions, extending outside the display area EH from the discharge portion.

The printing mask 90 has a mask pattern comprising a plurality of strip openings 95 for the main portions 22A of the address electrodes 22. The openings 95 have a width $w_{10}$ of, e.g., 60 μm, and a pitch of, e.g., 220 μm. These sizes are design sizes and therefore the actual size may be slightly different depending on manufacturing requirements.

Alternate ones of the openings 95 extend, at first ends 95, from the ends 95" of adjacent, alternate, openings 95 by a distance (d) to make the alignment with the corresponding connecting portions 22B or the silver paste patterns thereof 22B*a* easy.

Then, the printing mask 90 is cleaned by removing the adhered silver paste with a solvent or the like. Again, and using the same printing mask 90, low melting point glass paste patterns 29*a* for the barriers 29 are printed in a lamination manner several times, as shown in FIG. 25D.

At this time, the printing mask 90 can be placed at a location that is parallel to, but shifted by half of the pitch (p) from, the location at which it was placed for printing the main portions 22A*a* of the address electrodes, with the glass substrate 21 as a reference. Accordingly, the mask alignment problems can be substantially eliminated.

Figure 25D:
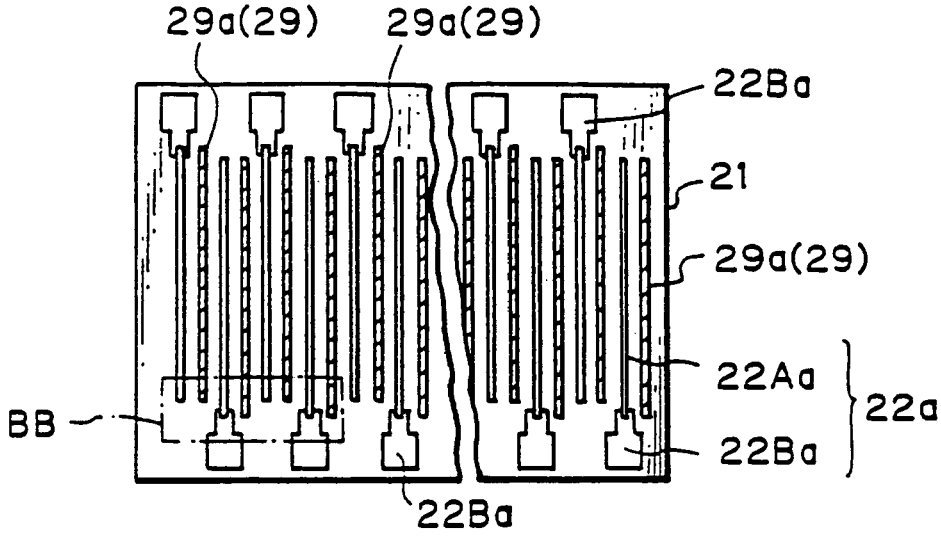
Figure 25E:
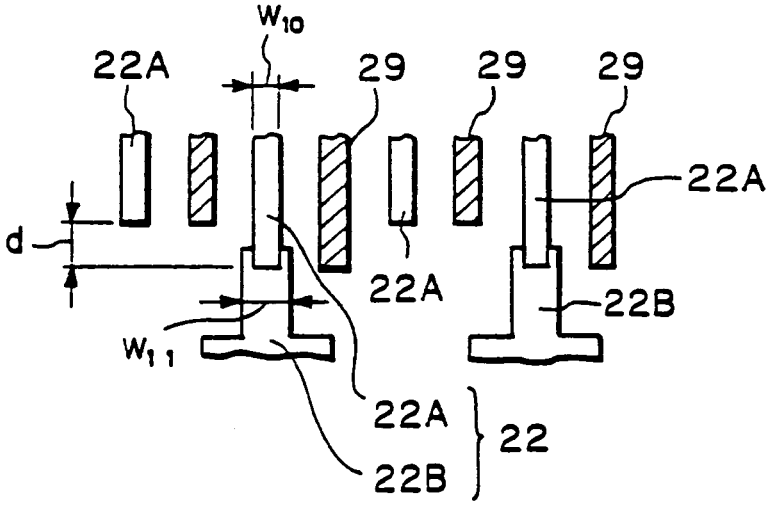

Then, the silver paste patterns 22A*a* and 22B*a* and the low melting point glass paste patterns 29*a* are fired together (i.e., at the same time, or simultaneously) to form the address electrodes 22 and the barriers 29, as shown in FIG. 25D. FIG. 25E corresponds to a portion BB enclosed by the dash-dot-line in FIG. 25D.

When the width $W_{10}$ of the openings 95 of the printing mask 90 is 60 μm, the practically obtained address electrodes 22 have a width of about 60 to 70 μm, and the practically obtained barriers 29 have a width of about 80 μm.

In the above example, since a display is not disturbed by overlap of the barriers 29 with the connecting portions 228, the width of the reduced portions 92 of the connecting portions 22B may be sufficiently enlarged, for example, to the came width as that of the enlarged portions 91, so that the alignment of the connecting portions 22B and the main portions 22A of the address electrodes 22 can be made easier.

It is apparent that the materials for the address electrodes or the barriers may vary.

What is claimed is:

1. A surface discharge type AC color plasma display panel rear substrate assembly, comprising:

a glass plate having a main surface;

plural address electrodes supported on the main surface of the glass plate in parallel relationship; and plural barrier ribs supported on the main surface of the glass plate with a height substantially equal to a gap length of a given discharge space and arranged to divide said discharge space into cells, each of which cells corresponding to a position of a respective said address electrode, said barrier ribs having a flat top portion of a width not less than 7.5 μm and a bottom portion of a width wider than the top portion.

2. A surface discharge type AC color plasma display panel rear substrate assembly, comprising:

a glass plate having a main surface;

plural address electrodes supported on the main surface of the glass plate in parallel relationship;

plural barrier ribs supported on the main surface of the glass plate with a height substantially equal to a gap length of a given discharge space and arranged to divide said discharge space into cells, each of which cells corresponds to a position of a respective said address electrodes, said barrier ribs having a flat top portion of a width not less than 7.5 μm and a bottom portion of a width wider than the top portion; and plural color phosphor layers of different primary colors formed in respective, plural cells and arranged in a repeating succession corresponding to said address electrodes, said color phosphor layers affording a charge storable surface and covering the address electrodes.

3. A surface discharge type AC color plasma display panel rear substrate assembly, comprising:

a glass plate having a main surface;

plural address electrodes supported on the main surface of the glass plate in parallel relationship; and plural barrier ribs, supported on the main surface of the glass plate and arranged to divide a discharge space into cells, each cell corresponding to a position of a respective said address electrode, said barrier ribs having a flat top portion of a width not less than 7.5 μm and a bottom portion of a width wider than the top portion.

4. A surface discharge type AC color plasma display panel rear substrate assembly, comprising:

a glass plate having a main surface;

plural address electrodes supported on the main surface of the glass plate in parallel relationship;

plural barrier ribs supported on the main surface of the glass plate and arranged to divide a discharge space into cells, each cell corresponds to a position of a respective said address electrode, said barrier ribs having a flat top portion of a width not less than 7.5 μm and a bottom portion of a width wider than the top portion; and plural color phosphor layers of different primary colors formed in respective, plural cells and arranged in a repeating succession, said color phosphor layers covering the address electrodes.

* * * * *

UNITED STATES PATENT AND TRADEMARK OFFICE

CERTIFICATE OF CORRECTION

PATENT NO. : 7,208,877 B2
APPLICATION NO. : 10/902813
DATED : April 24, 2007
INVENTOR(S) : Tsutae Shinoda et al.

It is certified that error appears in the above-identified patent and that said Letters Patent is hereby corrected as shown below:

Title Page, Item (56) (U.S. Patent Documents), Line 8, after "2/1981" change "Kamagaya et al." to --Kamegaya et al.--.

Page 2, Item (56) (Other Publications), Line 4, change "86-lpi" to --86-Ipi--.

Signed and Sealed this

Seventh Day of August, 2007

JON W. DUDAS
*Director of the United States Patent and Trademark Office*